US010813530B2

(12) United States Patent
Maddux

(10) Patent No.: US 10,813,530 B2
(45) Date of Patent: Oct. 27, 2020

(54) RACK MOUNT FOR A DISHWASHER APPLIANCE

(71) Applicant: Haier US Appliance Solutions, Inc., Wilmington, DE (US)

(72) Inventor: Benjamin Carl Maddux, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 66 days.

(21) Appl. No.: 15/992,318

(22) Filed: May 30, 2018

(65) Prior Publication Data

US 2019/0365197 A1 Dec. 5, 2019

(51) Int. Cl.
*A47L 15/50* (2006.01)

(52) U.S. Cl.
CPC ..... *A47L 15/507* (2013.01)

(58) Field of Classification Search
CPC ..... A47L 15/00–508
See application file for complete search history.

(56) References Cited

U.S. PATENT DOCUMENTS 4,359,250 A 11/1982 Jenkins
4,402,556 A * 9/1983 Schwind ..... F16C 13/006 384/281
5,366,185 A * 11/1994 Michael ..... A47L 15/42 248/27.1
5,549,760 A 8/1996 Becker
5,584,549 A 12/1996 Lybarger et al.
5,806,942 A 9/1998 Jenkins, Jr. et al.
9,579,010 B2 2/2017 Shewmaker
9,833,123 B2 12/2017 Shaffer et al.
2002/0185166 A1 12/2002 Rosenbauer et al.
2006/0219271 A1 10/2006 Feddema et al.
2007/0039904 A1 2/2007 Purushothaman
2009/0007944 A1* 1/2009 Haeberle ..... A47L 15/4246 134/201
2011/0133614 A1 6/2011 Bastuji
2015/0190033 A1* 7/2015 Shaffer ..... A47L 15/507 312/228.1

FOREIGN PATENT DOCUMENTS

EP 0186157 A1 7/1986
EP 1275336 A1 1/2003
EP 1800590 B1 3/2009

* cited by examiner

*Primary Examiner* — Spencer E Bell
(74) *Attorney, Agent, or Firm* — Dority & Manning, P.A.

(57) ABSTRACT

A rack mounting assembly for supporting an upper rack assembly within a tub of a dishwasher appliance is provided. The rack mounting assembly includes a mounting body that has features for supporting the upper rack assembly and for begin secured to the tub. The tub also includes various features for facilitating mounting of the mounting body thereto.

19 Claims, 15 Drawing Sheets

RACK MOUNT FOR A DISHWASHER APPLIANCE

FIELD OF THE INVENTION

The present disclosure relates generally to dishwasher appliances, and more particularly to rack mounting features for dishwasher appliances.

BACKGROUND OF THE INVENTION

Dishwasher appliances generally include a tub that defines a wash chamber. Rack assemblies can be mounted within the wash chamber of the tub for receipt of articles for washing. Multiple spray assemblies can be positioned within the wash chamber for applying or directing wash fluid towards articles disposed within the rack assemblies in order to clean such articles. Dishwasher appliances are also typically equipped with at least one pump for circulating fluid through the multiple spray assemblies. In addition, devices referred to as diverters may be used to control the flow of fluid received from the pump.

In addition to conventional lower and middle rack assemblies, certain dishwasher appliances include a "third rack" or "upper rack" positioned above the lower and middle rack assemblies, e.g., for receiving flatware, cutlery, or other cooking utensils. For both conventional and upper rack assemblies, properly supporting such rack assemblies within the tub of the dishwasher appliance typically requires the installation of a mounting bracket or assembly. However, installing such mounting brackets is often complicated, requiring multiple parts and increasing the potential for misalignment or improper mounting, particularly in plastic tubs that are typically not as rigid as stainless steel tubs.

Accordingly, a dishwasher appliance having improved rack mounting features would be useful.

BRIEF DESCRIPTION OF THE INVENTION

Aspects and advantages of the invention will be set forth in part in the following description, may be apparent from the description, or may be learned through practice of the invention.

In accordance with one exemplary embodiment of the present disclosure a dishwasher appliance is provided. The dishwasher appliance defines a vertical, a lateral, and a transverse direction. The dishwasher appliance includes a tub having an inner surface and an outer surface, the inner surface of the tub defining a wash chamber for receipt of articles for washing, the tub further defining a hole extending between an inner opening defined at the inner surface of the tub and a piercing wall. Further, the dishwasher appliance includes an upper rack assembly slidably positioned within the wash chamber and configured for movement along the transverse direction. Moreover, the dishwasher appliance includes a rack mounting assembly for supporting the upper rack assembly. The rack mounting assembly includes a mounting body and a mounting post projecting from the mounting body and received within the hole. Moreover, the rack mounting assembly includes a fastener piercing through the piercing wall and extending into the mounting post to secure the mounting body to the tub.

In accordance with another exemplary embodiment of the present disclosure, a dishwasher appliance is provided. The dishwasher appliance defines a vertical, a lateral, and a transverse direction. The dishwasher appliance includes a tub having an outer surface and an inner surface partially defining a wash chamber for receipt of articles for washing, the tub further comprising a first cantilevered support projecting from the inner surface and a second cantilevered support projecting from the inner surface and spaced from the first cantilevered support. The dishwasher appliance also includes an upper rack assembly slidably positioned within the wash chamber and movable along the transverse direction. Further, the dishwasher appliance includes a rack mounting assembly for supporting the upper rack assembly. The rack mounting assembly includes a mounting body extending between a front end and a back end, the mounting body supported by the first cantilevered support at or proximate the front end and the mounting body supported by the second cantilevered support at or proximate the back end.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
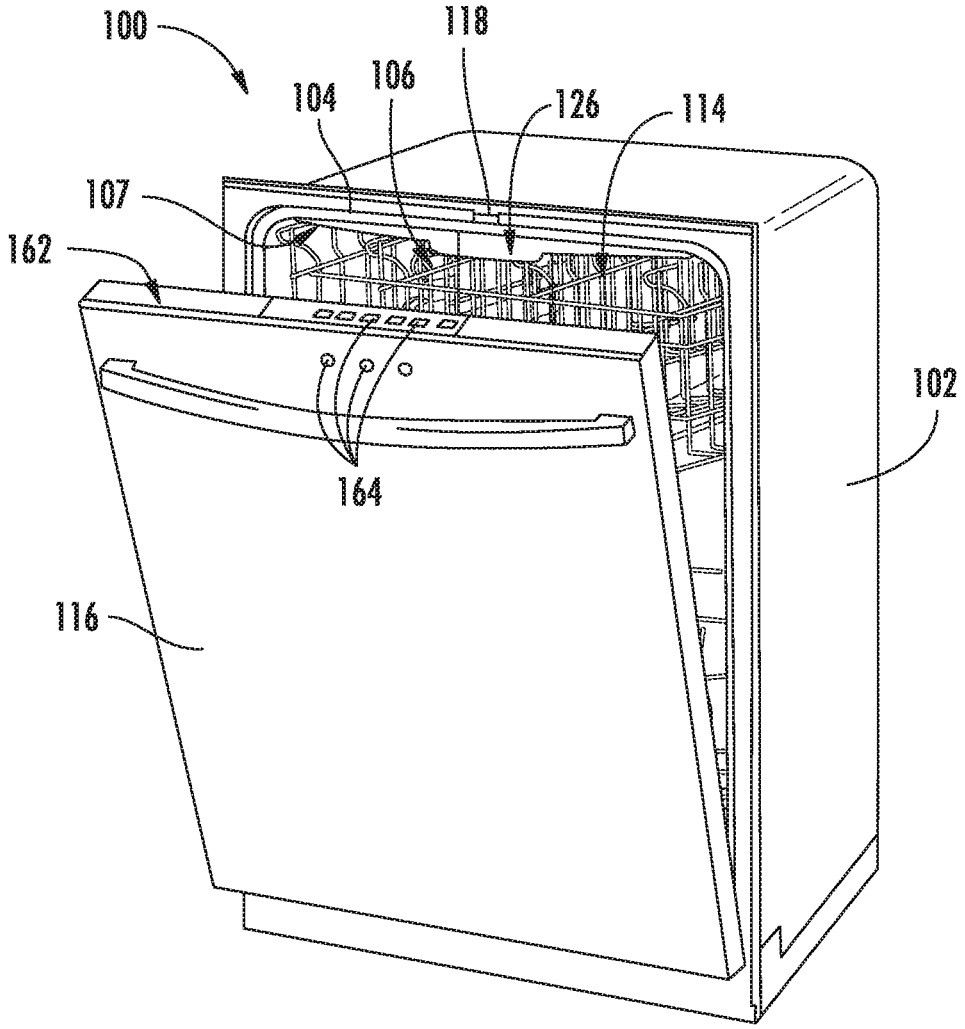
FIG. 1 provides a perspective view of an exemplary embodiment of a dishwashing appliance of the present disclosure with a door in a partially open position.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a detergent and water, preferably with agitation, to e.g., remove soil particles including food and other undesirable elements from the articles. The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance. The term "wash fluid" refers to a liquid used for washing and/or rinsing the articles and is typically made up of water that may include other additives such as detergent or other treatments. Furthermore, as used herein, terms of approximation, such as "approximately," "substantially," or "about," refer to being within a ten percent margin of error.

Figure 2:
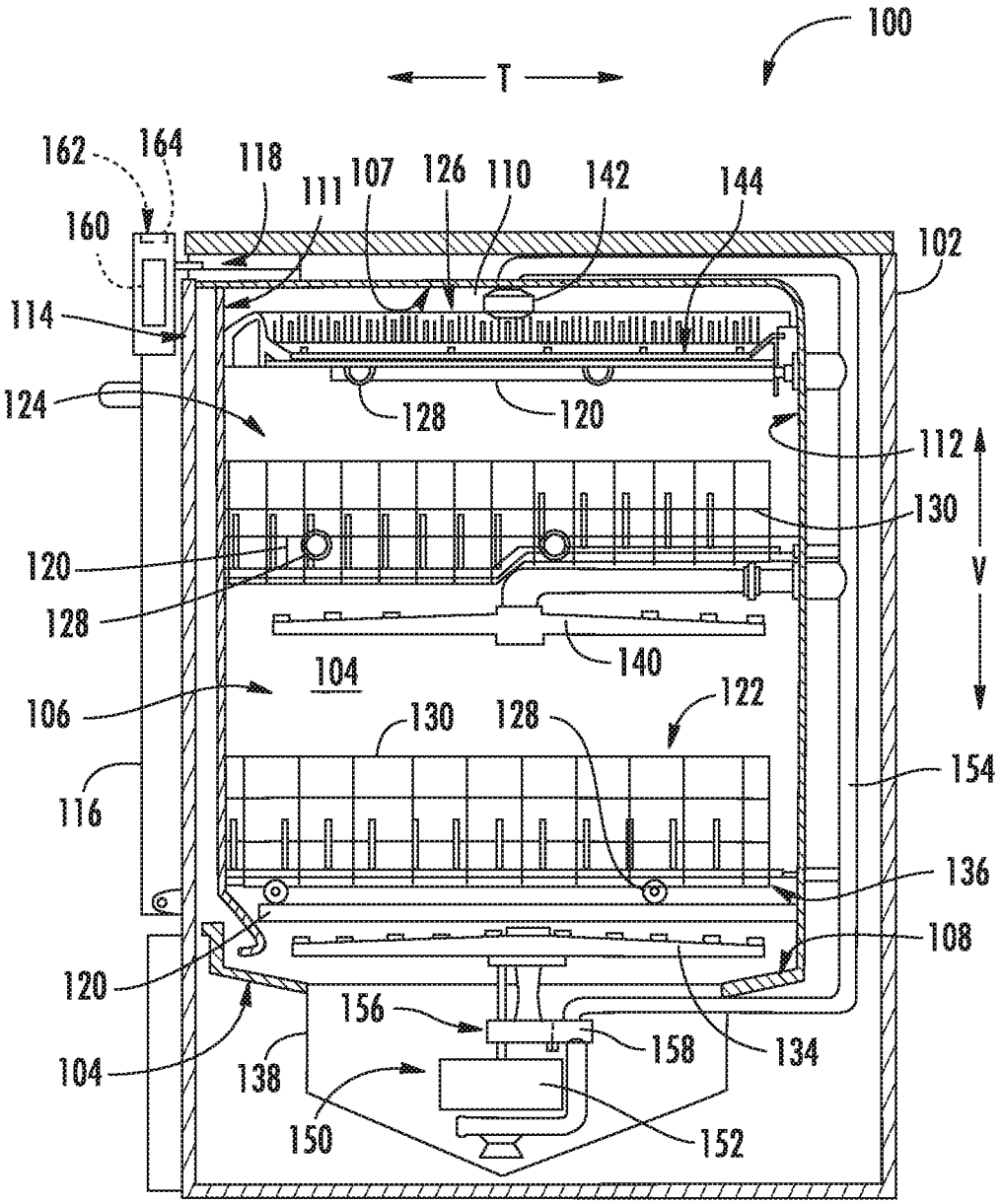
FIG. 2 provides a side, cross sectional view of the exemplary dishwashing appliance of FIG. 1.

FIGS. 1 and 2 depict an exemplary consumer dishwasher or dishwashing appliance 100 that may be configured in accordance with aspects of the present disclosure. For the particular embodiment of FIGS. 1 and 2, dishwasher 100 includes a cabinet 102 having a tub 104 therein that defines a wash chamber 106. As shown in FIG. 2, tub 104 extends between a top 107 and a bottom 108 along a vertical direction V, between a pair of side walls 110 along a lateral direction L (only one side wall shown in FIG. 2), and between a front side 111 and a rear side 112 along a transverse direction T. Each of the vertical direction V, lateral direction L, and transverse direction T are mutually perpendicular to one another.

Tub 104 includes a front opening 114 and a door 116 hinged at its bottom for movement between a normally closed vertical position (shown in FIG. 2), wherein the wash chamber 106 is sealed shut for washing operation, and an open position for loading and unloading of articles from the dishwasher 100 (shown in FIG. 1). According to exemplary embodiments, dishwasher 100 further includes a door closure mechanism or assembly 118 that is used to lock and unlock door 116 for accessing and sealing wash chamber 106.

As best illustrated in FIG. 2, tub side walls 110 accommodate a plurality of rack assemblies. More specifically, guide rails 120 may be mounted to side walls 110 for supporting a lower rack assembly 122, a middle rack assembly 124, and an upper rack assembly 126. As illustrated, upper rack assembly 126 is positioned at a top portion of wash chamber 106 above middle rack assembly 124, which is positioned above lower rack assembly 122 along the vertical direction V. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 124, 126, respectively. Although guide rails 120 and rollers 128 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are configured for supporting articles within wash chamber 106 while allowing a flow of wash fluid to reach and impinge on those articles, e.g., during a cleaning or rinsing cycle. According to another exemplary embodiment, a silverware basket (not shown) may be removably attached to a rack assembly, e.g., lower rack assembly 122, for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging and/or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

The various spray assemblies and manifolds described herein may be part of a fluid distribution system or fluid circulation assembly 150 for circulating water and wash fluid in the tub 104. More specifically, fluid circulation assembly 150 includes a pump 152 for circulating water and wash fluid (e.g., detergent, water, and/or rinse aid) in the tub 104. Pump 152 may be located within sump 138 or within a machinery compartment located below sump 138 of tub 104, as generally recognized in the art. Fluid circulation assembly 150 may include one or more fluid conduits or circulation piping for directing water and/or wash fluid from pump 152 to the various spray assemblies and manifolds. For example, as illustrated in FIG. 2, a primary supply conduit 154 may extend from pump 152, along rear 112 of tub 104 along the vertical direction V to supply wash fluid throughout wash chamber 106.

As illustrated in FIG. 2, primary supply conduit 154 is used to supply wash fluid to one or more spray assemblies, e.g., to mid-level spray arm assembly 140 and upper spray assembly 142. However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only, and are not limitations of the present subject matter.

In operation, pump 152 draws wash fluid in from sump 138 and pumps it to a diverter assembly 156, e.g., which is positioned within sump 138 of dishwasher appliance. Diverter assembly 156 may include a diverter disk (not shown) disposed within a diverter chamber 158 for selectively distributing the wash fluid to the spray arm assemblies 134, 140, 142 and/or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter assembly 156 is configured for selectively distributing the flow of wash fluid from pump 152 to various fluid supply conduits, only some of which are illustrated in FIG. 2 for clarity. More specifically, diverter assembly 156 may include four outlet ports (not shown) for supplying wash fluid to a first conduit for rotating lower spray arm assembly 134 in the clockwise direction, a second conduit for rotating lower spray arm assembly 134 in the counter-clockwise direction, a third conduit for spraying an auxiliary rack such as the silverware rack, and a fourth conduit for supply mid-level and/or upper spray assemblies 140, 142, i.e., such as primary supply conduit 154.

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 116 as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 includes a user interface panel/controls 164 through which a user may select various operational features and modes and monitor progress of the dishwasher 100. In one embodiment, the user interface 164 may represent a general purpose I/O ("GPIO") device or functional block. In one embodiment, the user interface 164 may include input components, such as one or more of a variety of electrical, mechanical or electro-mechanical input devices including rotary dials, push buttons, and touch pads. The user interface 164 may include a display component, such as a digital or analog display device designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 122, 124, 126, different spray arm assemblies 134, 140, 142 and spray manifold configurations may be used, and other differences may be applied while remaining within the scope of the present subject matter.

Figure 3:
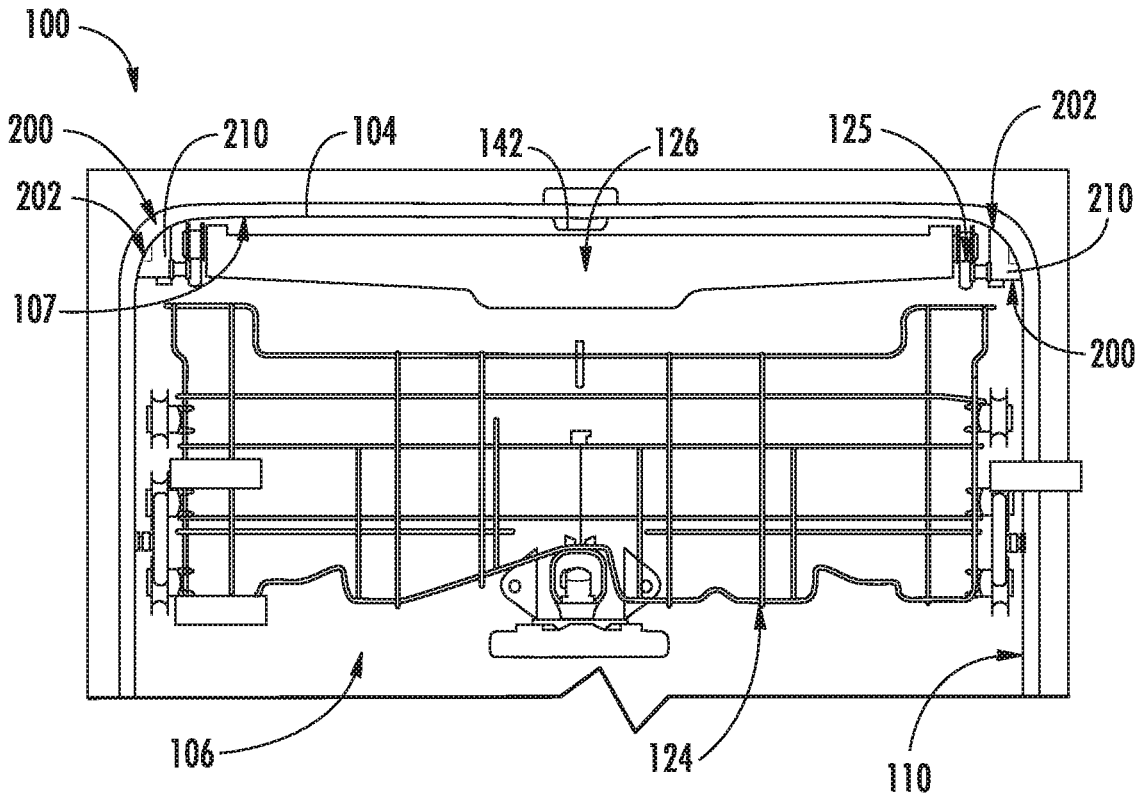
FIG. 3 provides a front view of an upper rack assembly of the exemplary dishwashing appliance of FIG. 1 according to an exemplary embodiment of the present subject matter.

FIG. 3 provides a front view of dishwashing appliance 100 of FIG. 1 according to an exemplary embodiment of the present subject matter. As shown, dishwasher appliance 100 includes two (2) rack mounting assemblies 200 positioned within wash chamber 106 and mounted to tub 104 for supporting upper rack assembly 126. However, it should be appreciated that aspects of the present subject matter may be used to support any suitable rack assembly in any suitable appliance. For example, mounting assemblies 200 or aspects thereof may be used to support lower rack assembly 122, middle rack assembly 124, or a rack of any other suitable appliance, such as a refrigerator or oven appliance.

As best illustrated in FIG. 3, rack mounting assemblies 200 of dishwasher appliance 100 are positioned at the top corners of tub 104. More specifically, tub 104 defines radiused corners 202 where top wall 107 and the left and right side walls 110 meet. Radiused corners 202 are frequently used in dishwasher appliance tubs to simplify the molding process and to improve the structural rigidity of tub 104. However, installing rack mounting assemblies 200 within such radiused corners 202 is often a difficult task. For example, space is limited within tub 104 and technicians often have to insert screws into blind holes.

According to exemplary embodiments of the present subject matter, tub 104 is injection-molded using any suitable plastic material. To facilitate simple removal of the molding tools used in the extrusion or molding process, side walls 110 of tub 104 may define a slight draft, i.e., side walls 110 do not extend perfectly along the transverse direction T. Radiused corners 202 and drafted side walls 110 can result in improperly aligned rack mounting assemblies 200 and in operational issues with upper rack assembly 126. Rack mounting assembly 200 or assemblies of the present disclosure rectify many of these issues.

Figure 4:
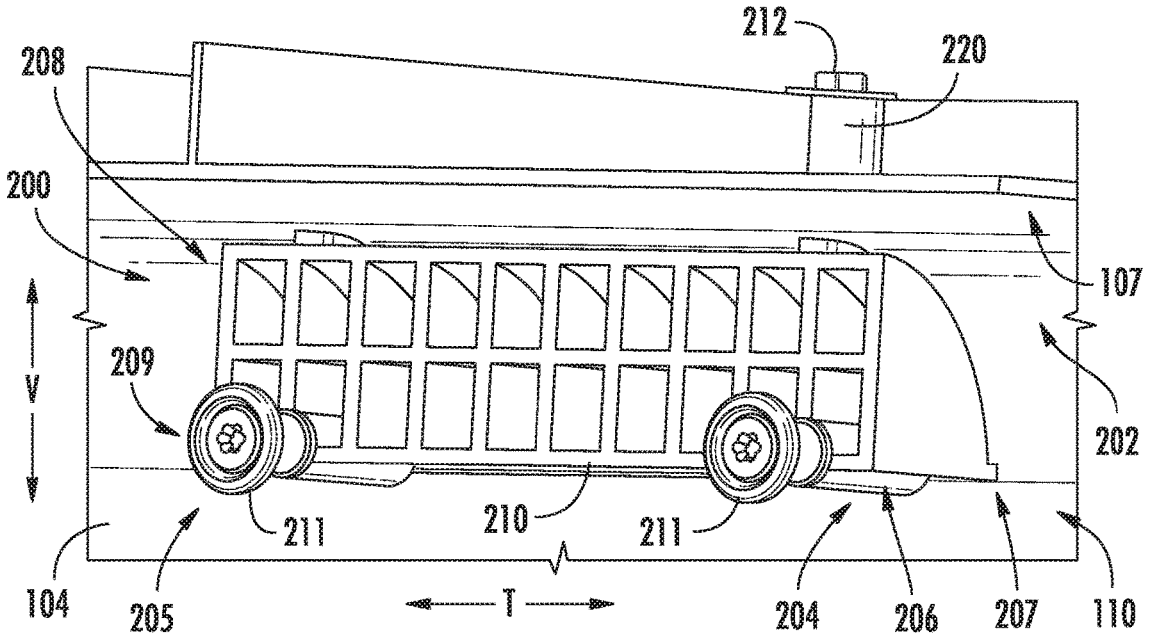
FIG. 4 provides a perspective view of an exemplary rack mounting assembly mounted to a tub of a dishwasher appliance according to an exemplary embodiment of the present subject matter.
Figure 5:
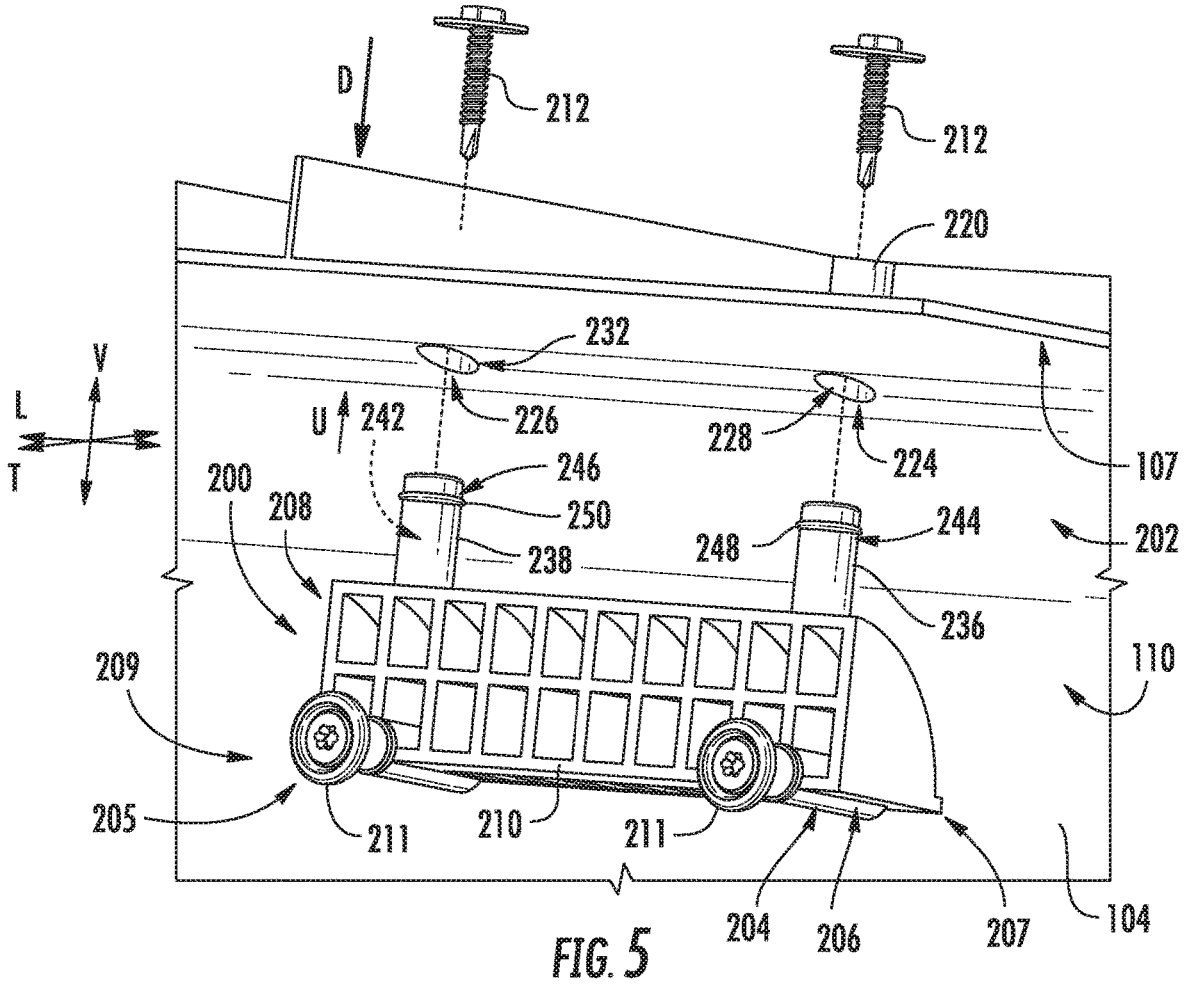
FIG. 5 provides a partial exploded view of the rack mounting assembly of FIG. 4 depicting a mounting body positioned for mounting to the tub.
Figure 6:
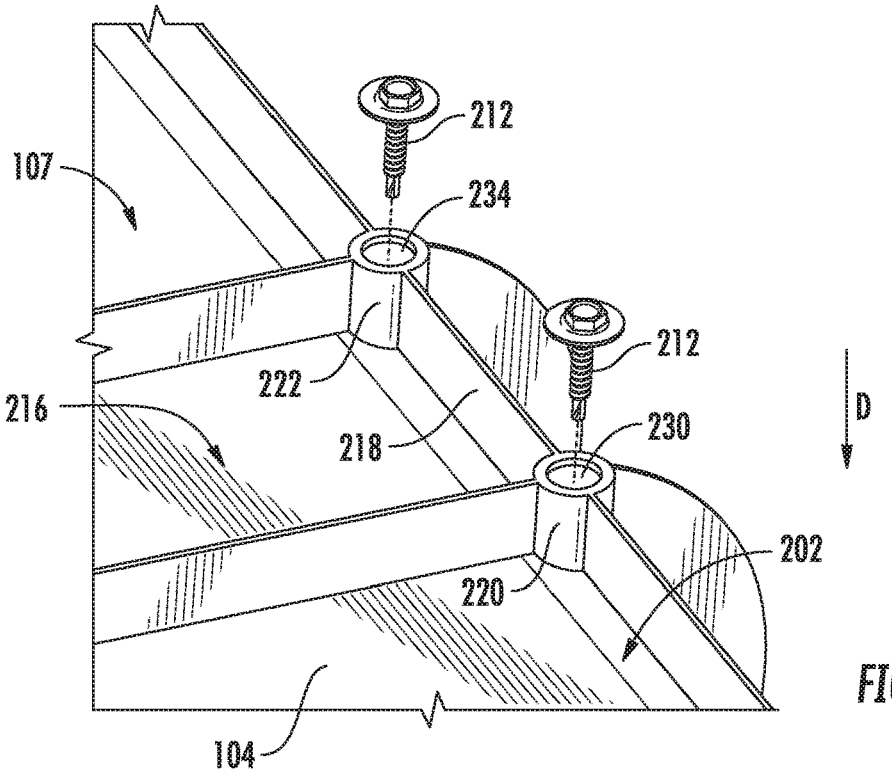
FIG. 6 provides a perspective view of mechanical fasteners positioned for being driven into the tub of FIG. 4.
Figure 7:
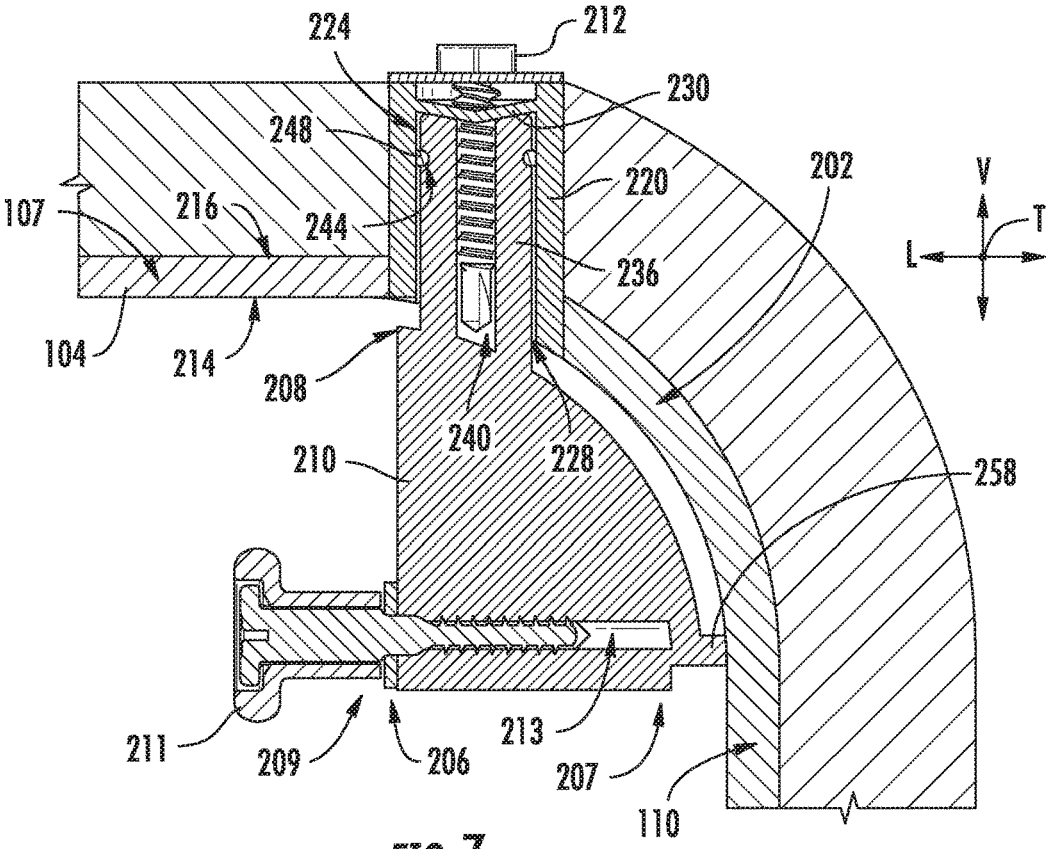
FIG. 7 provides a close-up, front cross-sectional view of the rack mounting assembly of FIG. 4.

FIGS. 4, 5, 6, and 7 provide various views of features of one exemplary embodiment of rack mounting assembly 200. In particular, FIG. 4 provides a perspective view of rack mounting assembly 200 mounted to tub 104, which is shown partially in cross section. FIG. 5 provides a partial exploded view of rack mounting assembly 200 depicting a mounting body 210 positioned for mounting to tub 104. FIG. 6 provides a perspective view of mechanical fasteners 212 positioned for being driven into tub 104. FIG. 7 provides a close-up, front cross-sectional view of rack mounting assembly 200.

As illustrated, rack mounting assembly 200 includes mounting body 210 that is mountable to tub 104 using mechanical fasteners 212, such as screws, bolts, rivets, etc. Although mounting body 210 is illustrated herein as being mounted proximate the right side wall 110, it should be appreciated that mounting body 210 may also be mounted on the left side wall 110 (e.g., as shown in FIG. 3). Mounting body 210 may be used for both the left side and right side rack mounting assemblies 200. For this embodiment, mounting body 210 is injection-molded using any suitable type of plastic.

Generally, tub 104 has an inner surface 214 and an opposing outer surface 216. Inner surface 214 defines wash chamber 106 and outer surface 216 is external to wash chamber 106. For top wall 107, inner surface 214 of tub 104 is spaced from outer surface 216, e.g., along the vertical direction V. For side wall 110, inner surface 214 is spaced from outer surface 216, e.g., along the lateral direction L. For radiused corner 202, inner surface 214 is spaced from outer surface 216, e.g., as shown in FIG. 7. Moreover, tub 104 includes a plurality of structural ribs 218 projecting from outer surface 216 of tub 104. Notably, as best shown in FIG. 6, structural ribs 218 connect a first tub boss 220 and a second tub boss 222 that project from tub 104, e.g., along the vertical direction V. Second tub boss 222 is spaced from first tub boss 220, e.g., along the transverse direction T. For this embodiment, first tub boss 220 and second tub boss 222 ae each cylindrical projections and are each positioned at a location where top wall 107 joins with or connects with radiused corner 202 as shown best in FIGS. 6 and 7.

As shown best in FIGS. 5, 6, and 7, tub 104 defines a first hole 224 and a second hole 226 spaced from first hole 224, e.g., along the transverse direction T. More particularly, first hole 224 is defined by first tub boss 220 and second hole 226 is defined by second tub boss 222. First hole 224 extends between an inner opening 228 defined at inner surface 214 of tub 104 and a first piercing wall 230, e.g., along the vertical direction V. First hole 224 is a blind hole if first piercing wall 230 has not been pierced, e.g., as shown in FIG. 6. Likewise, second hole 226 extends between an inner opening 232 defined at inner surface 214 of tub 104 and a second piercing wall 234, e.g., along the vertical direction V. Second hole 226 is a blind hole if second piercing wall 234 has not been pierced, e.g., as shown in FIG. 6. As shown in FIG. 6, first piercing wall 230 and second piercing wall 234 are recessed with respect to the top end of the their respective tub bosses 220, 222. Further, as first hole 224 and second hole 226 of first tub boss 220 and second tub boss 222, respectively, are blind holes (e.g., a hole that opens on only one end) if their respective first and second piercing walls 230, 234 have not been pierced, tub 104 is advantageously manufactured without any holes. In this way, tub 104 may be utilized for non-upper rack models without need to plug or seal the holes to prevent leakage therethrough.

As shown best in FIGS. 4 and 5, mounting body 210 extends between a front end 204 and a back end 205, e.g., along the transverse direction T, between a first side 206 and a second side 207, e.g., along the lateral direction L, and between a top 208 and a bottom 209, e.g., along the vertical direction V. First side 206 faces toward the interior of wash chamber 106 (FIG. 3) and extends substantially within a plane orthogonal to the lateral direction L. Second side 207 faces toward tub 104, e.g., toward radiused corner 202 and is curved to substantially match the contour of radiused corner 202. Mounting body 210 may define a plurality of roller holes 213 (one shown in FIG. 7) extending through first side 206 along the lateral direction L and being configured to receive rollers 211 for a slide assembly 125 of upper rack assembly 126 (FIG. 3). Although rollers 211 are illustrated as supporting upper rack assembly 126, it should be appreciated that rack mounting assembly 200 may alternatively include any suitable rack support mechanism for supporting any size or type of rack.

As shown particularly in FIG. 5, a first mounting post 236 projects from mounting body 210 and is received within first hole 224 defined by first tub boss 220, e.g., when mounting body 210 is mounted to tub 104. More specifically, first mounting post 236 projects from arcuate second side 207 proximate top 208 of mounting body 210. First mounting post 236 is generally cylindrical and projects from mounting body 210, e.g., along the vertical direction V. A second mounting post 238 projects from mounting body 210 and is received within second hole 226 defined by second tub boss 222, e.g., when mounting body 210 is mounted to tub 104. Specifically, second mounting post 238 projects from arcuate second side 207 proximate top 208 of mounting body 210. Second mounting post 238 is generally cylindrical and projects from mounting body 210, e.g., along the vertical direction V. Second mounting post 238 is spaced from first mounting post 236, e.g., along the transverse direction T. Particularly, second mounting post 238 is spaced from first mounting post 236 approximately the same distance as second tub boss 222 is spaced from first tub boss 220.

As best shown in FIG. 7, for this embodiment, first mounting post 236 defines a first pilot hole 240 that extends the length of first mounting post 236 along the vertical direction V. First pilot hole 240 is concentric with first mounting post 236. When mounting body 210 is mounted to tub 104, first pilot hole 240 is configured to receive one of fasteners 212 (e.g., a first fastener) as shown in FIG. 7. In some embodiments, the diameter of first pilot hole 240 is smaller than the diameter of the shank of the fastener 212. In this way, the fastener 212 threads into the sidewalls of first mounting post 236 defining first pilot hole 240. In some alternative embodiments, the sidewalls of first mounting post 236 defining first pilot hole 240 may include threading shaped complementary to the threading of fastener 212. Similarly, second mounting post 238 defines a second pilot hole 242 (FIG. 5) that extends the length of second mounting post 238 along the vertical direction V. Second pilot hole 242 is concentric with second mounting post 238. When mounting body 210 is mounted to tub 104, second pilot hole 242 is configured to receive one of fasteners 212 (e.g., a second fastener). In some embodiments, the diameter of second pilot hole 242 is smaller than the diameter of the shank of the fastener 212 received therein. In this way, the fastener 212 threads into the sidewalls of second mounting post 238 defining second pilot hole 242. In some alternative embodiments, the sidewalls of second mounting post 238 defining second pilot hole 242 may include threading shaped complementary to the threading of fastener 212. Further, in some embodiments, first mounting post 236 may not include first pilot hole 240 and second mounting post 238 may not include second pilot hole 242. In such embodiments, fasteners 212 are self-drilling fasteners.

Figure 10:
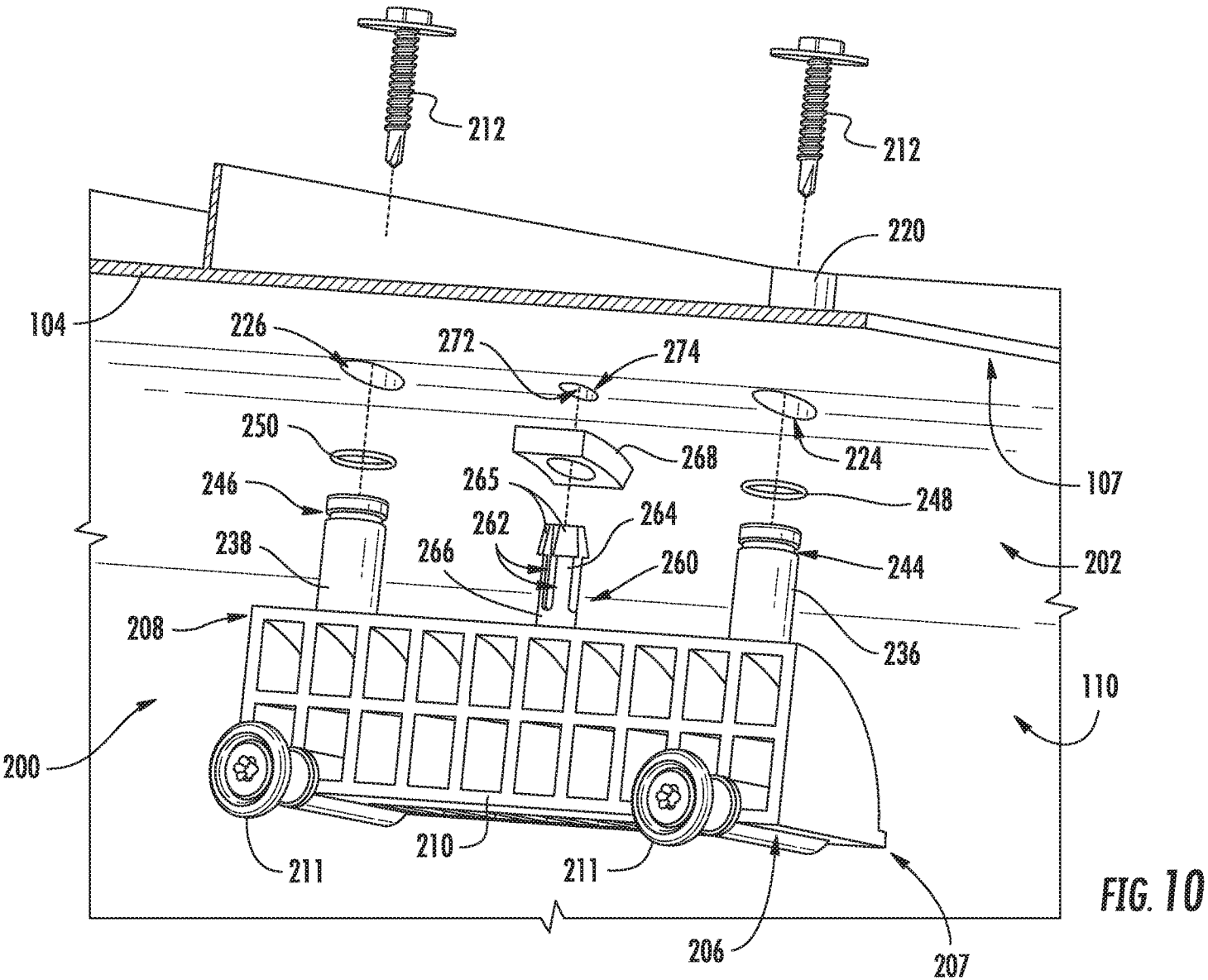
FIGS. 10 through 12 provide various view of another exemplary rack mounting assembly being mounted to a tub of a dishwasher appliance according to an exemplary embodiment of the present subject matter.

For this embodiment, first mounting post 236 defines a recess 244 extending circumferentially about first mounting post 236 (see FIG. 10 for additional clarity). Similarly, second mounting post 238 defines a recess 246 extending circumferentially about second mounting post 238 (see FIG. 10 for additional clarity). A first sealing member 248 is received within recess 244 of first mounting post 236 and a second sealing member 250 is received within recess 246 of second mounting post 238, e.g. as shown in FIG. 5. First sealing member 248 and second sealing member 250 may each be O-rings, for example. First and second sealing members 248, 250 may be pre-assembled with their respective first and second mounting posts 236, 238 or may be overmolded thereto. As shown best in FIG. 7, when first mounting post 236 is received within first hole 224 of first tub boss 220, first sealing member 248 is positioned between inner opening 228 of first hole 224 and first piercing wall 230 and is compressed between first mounting post 236 and an inner surface of first tub boss 220. Likewise, although not shown, when second mounting post 238 is received within second hole 226 of second tub boss 222, second sealing member 250 is positioned between inner opening 232 of second hole 226 and second piercing wall 234 and is compressed between second mounting post 238 and an inner surface of second tub boss 222. Thus, first sealing member 248 and second sealing member 250 prevent wash fluid from leaking out of wash chamber 106, e.g., during a wash cycle.

In addition, for this exemplary embodiment, rack mounting assembly 200 includes an additional feature to ensure proper alignment of mounting body 210 within tub 104. As shown best in FIG. 7, mounting body 210 defines a lateral standoff 258 projecting from second side 207 of mounting body 210. In general, lateral standoff 258 is positioned between mounting body 210 and side wall 110, e.g., along the lateral direction L when mounting body 210 is mounted to tub 104. Further, lateral standoff 258 extends along the transverse direction T.

An exemplary manner in which mounting body 210 maybe secured to tub 104 will now be provided. First mounting post 236 is aligned with first hole 224 defined by first tub boss 220 of tub 104 and second mounting post 238 is aligned with second hole 226 defined by second tub boss 222 of tub 104. Once aligned, first mounting post 236 is inserted upward U along the vertical direction V into first hole 224 and likewise second mounting post 238 is inserted upward U along the vertical direction V into second hole 226. The upward insertion of first and second mounting posts 236, 238 into their respective first and second pilot holes 240, 242 may be stopped when first mounting post 236 is stopped by first piercing wall 230 and when second mounting post 238 is stopped by second piercing wall 234. Thus, first piercing wall 230 and second piercing wall 234 provide stops and provide feedback to an operator that the mounting posts 236, 238 are fully inserted into position.

Once mounting body 210 is properly positioned with first and second mounting posts 236, 238 in place, one fastener 212 is driven downward D along the vertical direction V to pierce through first piercing wall 230 and one fastener 212 is driven downward D along the vertical direction V to pierce through second piercing wall 234. As shown particularly in FIG. 7, once fastener 212 has pierced through first piercing wall 230, fastener 212 is driven into first pilot hole 240 defined by first mounting post 236. As fastener 212 is driven downward D, fastener 212 self-taps or creates its own thread along the sidewall of first mounting post 236 defining first pilot hole 240. Accordingly, fastener 212 pierces through first piercing wall 230 and extends into first mounting post 236 to secure mounting body 210 to tub 104. In a similar fashion, once the other fastener 212 has pierced through second piercing wall 234, fastener 212 is driven into second pilot hole 242 defined by second mounting post 238. As fastener 212 is driven downward D, fastener 212 self-taps or creates its own thread along the sidewall of second mounting post 238 defining second pilot hole 242. Accordingly, fastener 212 pierces through second piercing wall 234 and extends into second mounting post 238 to secure mounting body 210 to tub 104. Notably, the fasteners 212 are driven externally. That is, fasteners 212 are driven from a position external to tub 104 inward into tub 104. In this way, assembly line operations and ease of manufacturability of rack mounting assembly 200 may be improved.

Further, as noted above, when mounting body 210 is mounted to tub 104, first sealing member 248 is positioned between inner opening 228 of first hole 224 and first piercing wall 230 and is compressed between first mounting post 236 and an inner surface of first tub boss 220 and second sealing member 250 is positioned between inner opening 232 of second hole 226 and second piercing wall 234 and is compressed between second mounting post 238 and an inner surface of second tub boss 222. Thus, first sealing member 248 and second sealing member 250 prevent wash fluid from leaking out of wash chamber 106.

Figure 8:
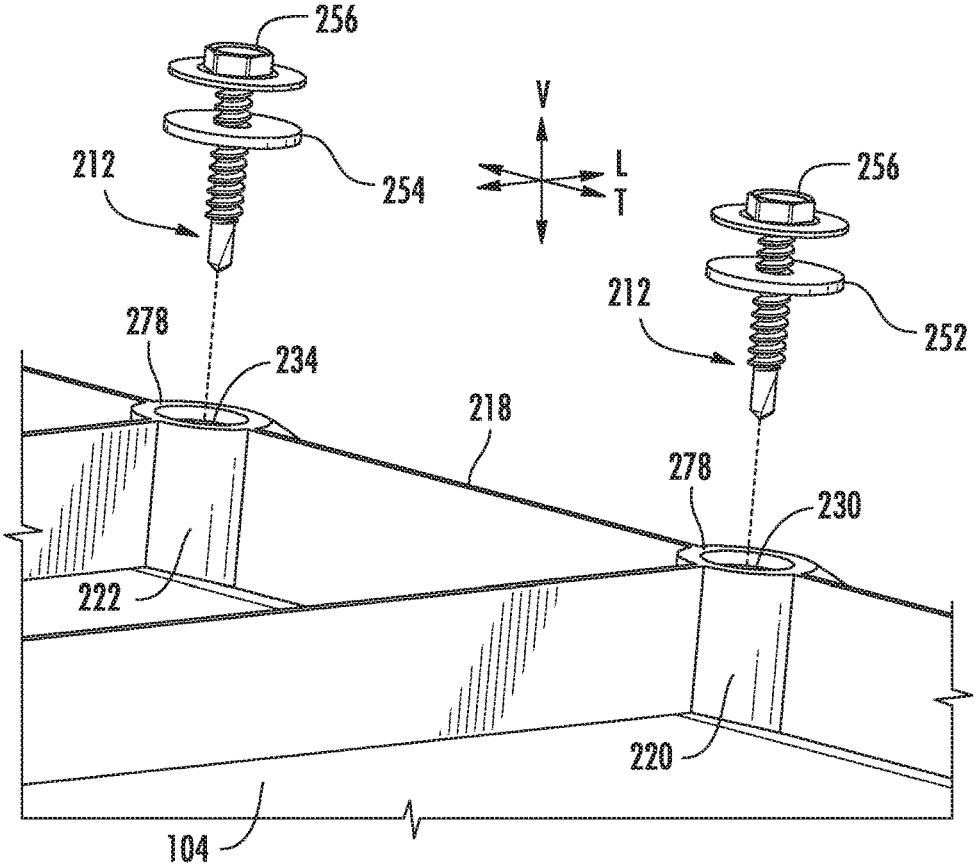
FIGS. 8 and 9 provide various view of another exemplary rack mounting assembly being mounted to a tub of a dishwasher appliance according to an exemplary embodiment of the present subject matter.
Figure 9:
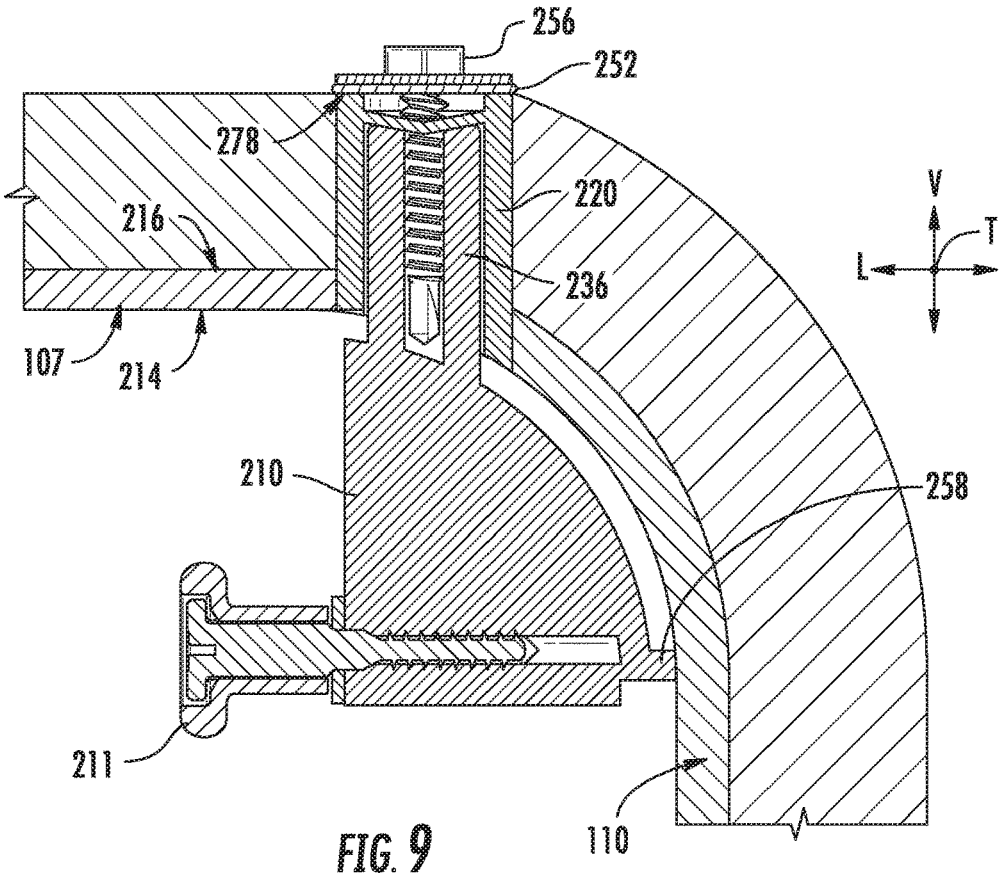

FIGS. 8 and 9 provide various views of features of another exemplary embodiment of rack mounting assembly 200. In particular, FIG. 8 provides a perspective view of mechanical fasteners 212 positioned for being driven into tub 104. FIG. 9 provides a close-up, front cross-sectional view of rack mounting assembly 200. The exemplary rack mounting assembly 200 of FIGS. 8 and 9 is configured in a similar manner as the rack mounting assembly of FIGS. 4 through 7, and accordingly, the same or similar numbering refers to the same or similar part.

By contrast with the rack mounting assembly of FIGS. 4 through 7, rack mounting assembly 200 of FIGS. 8 and 9 includes a first sealing gasket 252 and a second sealing gasket 254. First sealing gasket 252 defines an opening through which one of the fasteners 212 extends and second sealing gasket 254 defines an opening through which another fastener 212 extends. Moreover, in contrast with the embodiment depicted in FIGS. 4 through 7, first mounting post 236 and second mounting post 238 do not define recess 244 or recess 246, respectively. As shown best in FIG. 9, first mounting post 236 has a smooth outer surface without a recess. Although not shown, second mounting post 238 likewise has a smooth outer surface without a recess. When mounting body 210 is mounted to tub 104 and fasteners 212 are driven into place (which may be accomplished in a similar fashion as described above), first sealing gasket 252 is compressed and positioned between a head 256 of fastener 212 and an outer rim 278 of first tub boss 220, e.g., along the vertical direction V. In a similar fashion, although not shown, second sealing gasket 254 is compressed and positioned between a head of fastener 212 and outer rim 278 of second tub boss 222 (FIG. 8), e.g., along the vertical direction V. Advantageously, for this embodiment, first and second sealing gaskets 252, 254 may be preassembled with fasteners 212 and an operator may more easily inspect whether first and second sealing gaskets 252, 254 have been properly sealed against tub 104.

Figure 11:
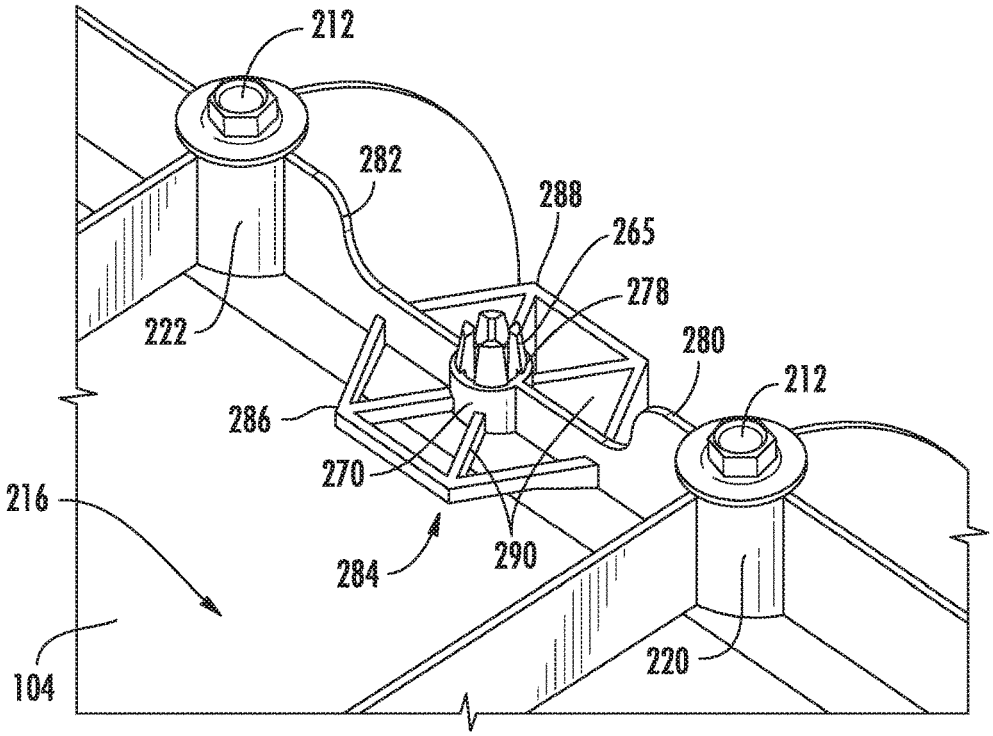
Figure 12:
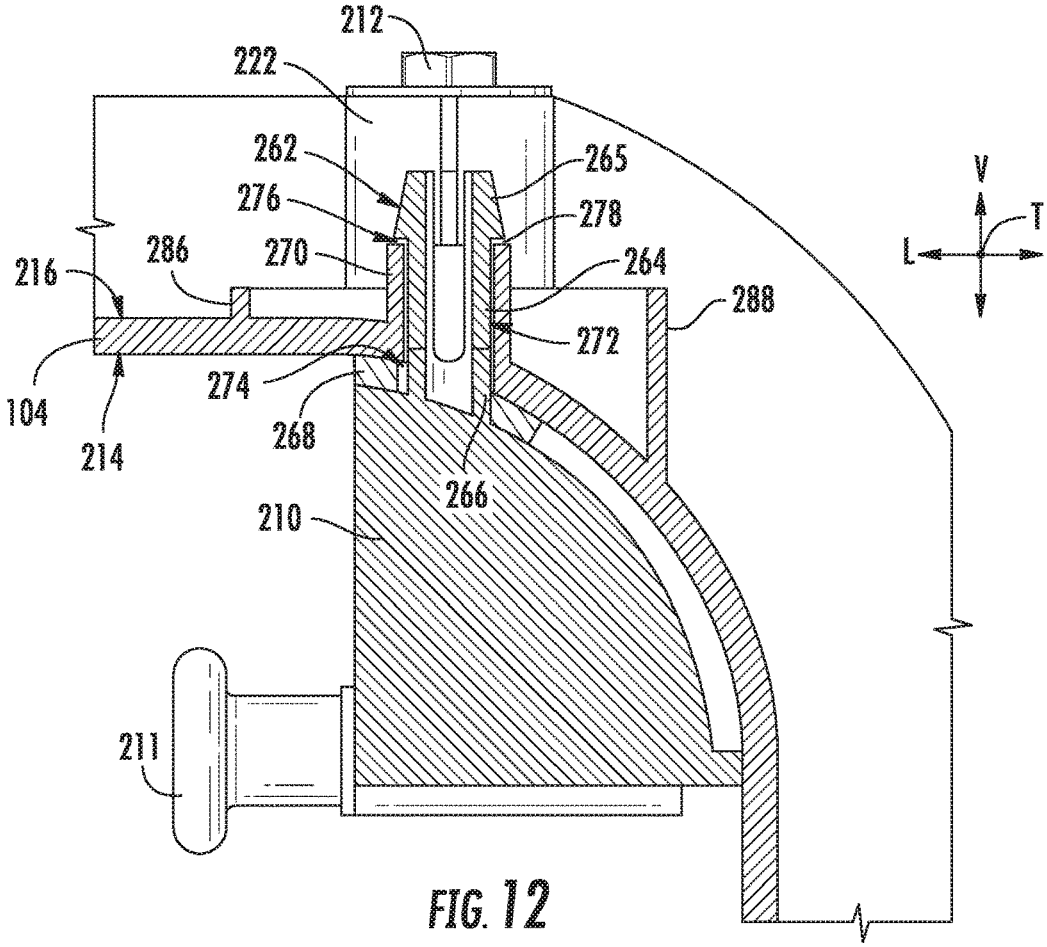

FIGS. 10, 11, 12 provide various views of features of another exemplary embodiment of rack mounting assembly 200. In particular, FIG. 10 provides a partial exploded view of rack mounting assembly 200 depicting mounting body 210 positioned for mounting to tub 104. FIG. 11 provides a perspective view of mechanical fasteners 212 securing mounting body 210 to tub 104. FIG. 12 provides a close-up, front cross-sectional view of rack mounting assembly 200. The exemplary rack mounting assembly 200 of FIGS. 10, 11, and 12 is configured in a similar manner as the rack mounting assembly of FIGS. 4 through 7, and accordingly, the same or similar numbering refers to the same or similar part.

For this embodiment, mounting body 210 of rack mounting assembly 200 includes an additional feature for securing mounting body 210 to tub 104. As shown, mounting body 210 includes a snap member 260 projecting therefrom. In particular, snap member 260 projects from second side 207 of mounting body 210 at top 208. Snap member 260 projects generally along the vertical direction V. Snap member 260 has one or more snaps 262 that are circumferentially spaced from one another. For this embodiment, snap member 260 includes four (4) snaps 262. Each snap 262 has a flexible post 264 that extends from a base 266 of snap member 260 along the vertical direction V and each snap 262 has an anchor member 265 formed at a distal end of their respective flexible posts 264.

As shown in FIG. 10, rack mounting assembly 200 also includes a sealing gasket 268. Sealing gasket 268 defines an opening through which snap member 260 may be received. As shown best in FIG. 12, when mounting body 210 is mounted to tub 104, sealing gasket 268 is disposed about base 266 of snap member 260 and is in sealing engagement with mounting body 210 and inner surface 214 of tub 104. For this embodiment, sealing gasket 268 has an arcuate shape that is shaped complementary to radiused corner 202 of tub 104 such that a liquid tight seal may be formed around base 266 of snap member 260.

Moreover, as shown, tub 104 includes a snap mounting boss 270 projecting from outer surface 216 of tub 104. Snap mounting boss 270 projects from outer surface 216 of tub 104 approximately where top wall 107 joins or transitions into radiused corner 202 as shown particularly in FIG. 12. Further, as shown best in FIG. 11, snap mounting boss 270 projects from tub 104 between first tub boss 220 and second tub boss 222, e.g., along the transverse direction T. Specifically, snap mounting boss 270 projects from tub 104 midway between first tub boss 220 and second tub boss 222 along the transverse direction T. Snap mounting boss 270 defines a hole 272 that extends between an inner opening 274 at inner surface 214 of tub 104 and an outer opening 276. Snap mounting boss 270 has an outer rim 278 at outer opening 276.

As shown best in FIG. 11, a first connecting rib 280 projects from outer surface 216 of tub 104, e.g., along the vertical direction V, and extends between and connects first tub boss 220 with snap mounting boss 270, e.g., along the transverse direction T. A second connecting rib 282 projects from outer surface 216 of tub 104, e.g., along the vertical direction V, and extends between and connects second tub boss 222 with snap mounting boss 270, e.g., along the transverse direction T. First and second connecting ribs 280, 282 provide structural support for mounting of mounting body 210 to tub 104. In addition, a hexagonal rib assembly 284 projects from outer surface 216 of tub 104. A first member 286 forms three (3) sides of hexagonal rib assembly 284 on one side of snap mounting boss 270 and a second member 288 forms three (3) sides of hexagonal rib assembly 284 on the other side of snap mounting boss 270. First member 286 connects at its forward end to first connecting rib 280 and at its rear end to second connecting rib 282. Similarly, second member 288 connects at its forward end to first connecting rib 280 and at its rear and to second connecting rib 282. Radial members 290 extend radially between and connect snap mounting boss 270 with first member 286 as well as snap mounting boss 270 with second member 288. Hexagonal rib assembly 284 provides additional structural integrity to tub 104 proximate snap mounting boss 270.

For this embodiment, to mount mounting body 210 to tub 104, first mounting post 236 is aligned with first hole 224 defined by first tub boss 220 of tub 104, second mounting post 238 is aligned with second hole 226 defined by second tub boss 222, and snap member 260 is aligned with hole 272 defined by snap mounting boss 270 of tub 104. Sealing gasket 268 may be positioned about base 266 of snap member 260. Once aligned, first mounting post 236 is inserted upward U along the vertical direction V into first hole 224, second mounting post 238 is inserted upward U along the vertical direction V into second hole 226, and snap member 260 is inserted upward U along the vertical direction V into hole 272. When this occurs, sealing gasket 268 is positioned between inner surface 214 of tub 104 and mounting body 210, e.g., as shown in FIG. 12. Further, when snap member 260 is received within hole 272, snaps 262 engage outer rim 278 of snap mounting boss 270 to retain mounting body 210 to tub 104. More particularly, the anchor members 265 of each snap 262 engage outer rim 278 to retain mounting body 210 to tub 104, e.g., as shown in FIGS. 11 and 12.

Once mounting body 210 is properly positioned with first and second mounting posts 236, 238 in place and snap member 260 securing mounting body 210 to tub 104, fasteners 212 are driven through their respective first and second piercing walls 230, 234 and into their respective first and second pilot holes 240, 242 of first and second mounting posts 236, 238 as described above. When mounting body 210 is secured to tub 104, sealing gasket 268 is compressed between tub 104 and mounting body 210 to prevent leakage from wash chamber 106, e.g., during operation of dishwasher appliance 100. Notably, for this embodiment, as snap member 260 retains mounting body 210 to tub 104 by snapping into engagement with outer rim 278 of snap mounting boss 270, an operator need not hold mounting body 210 in place while fasteners 212 are driven into tub 104 and mounting body 210 is prevented from being pushed downward D along the vertical direction V when fasteners 212 are being driven into tub 104. Thus, snap member 260 may advantageously ease assembly and provides an additional feature for securing mounting body 210 to tub 104.

Figure 13:
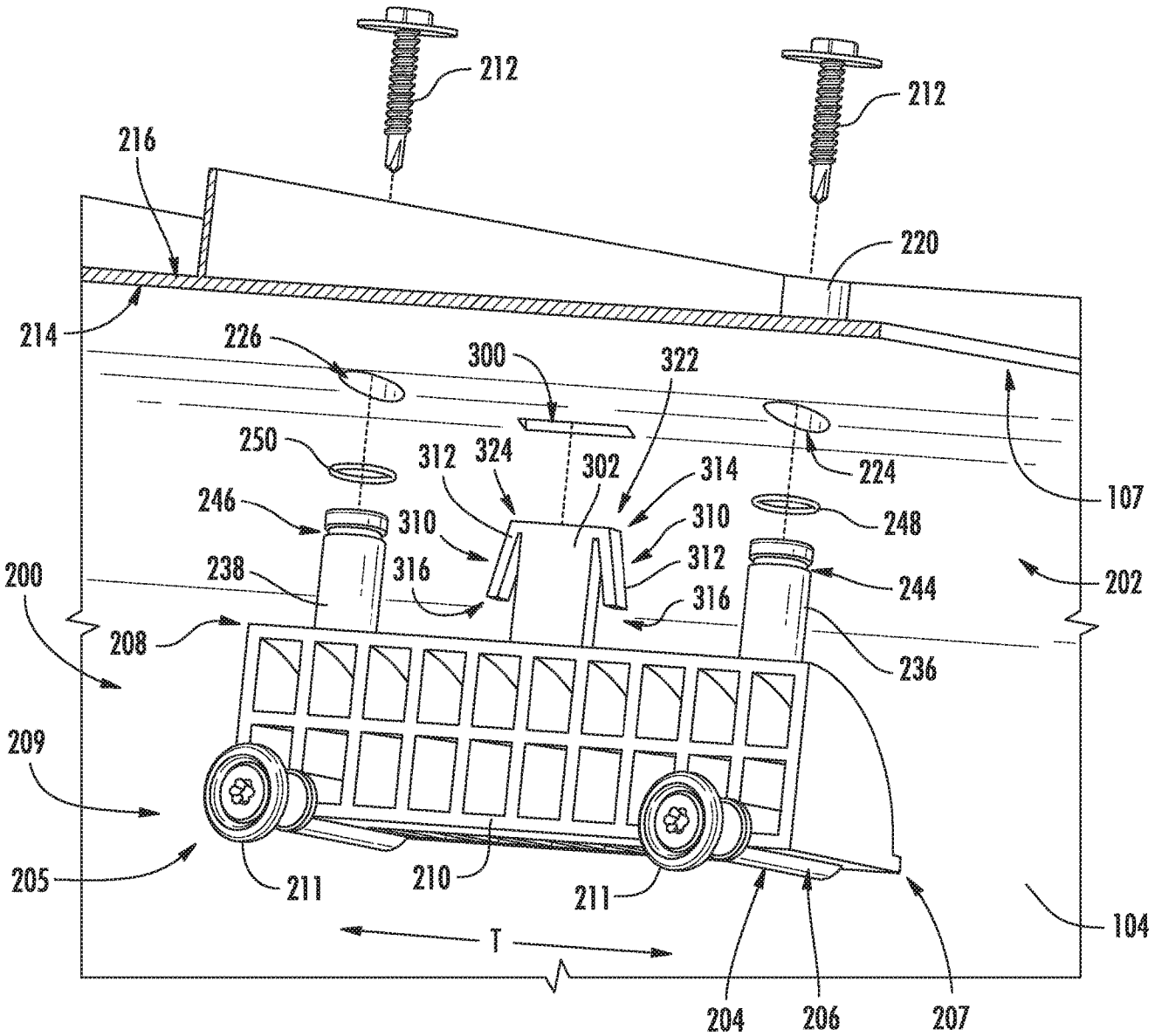
FIGS. 13 through 16 provide various view of another exemplary rack mounting assembly being mounted to a tub of a dishwasher appliance according to an exemplary embodiment of the present subject matter.
Figure 14:
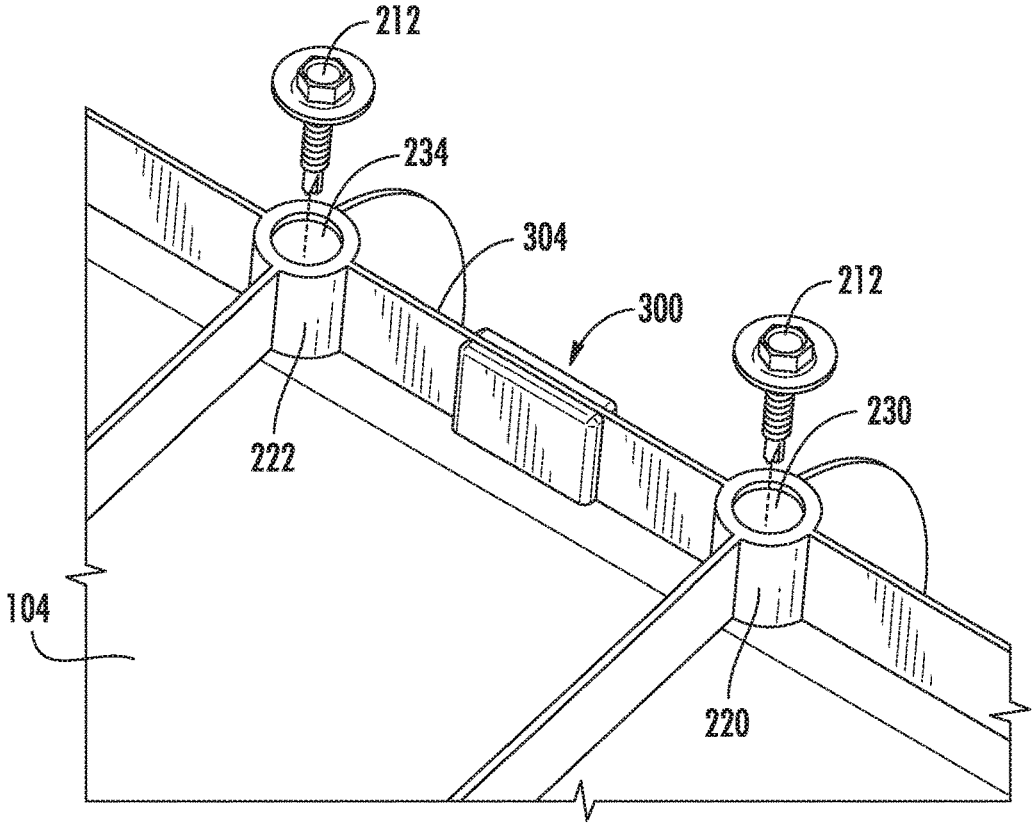
Figure 15:
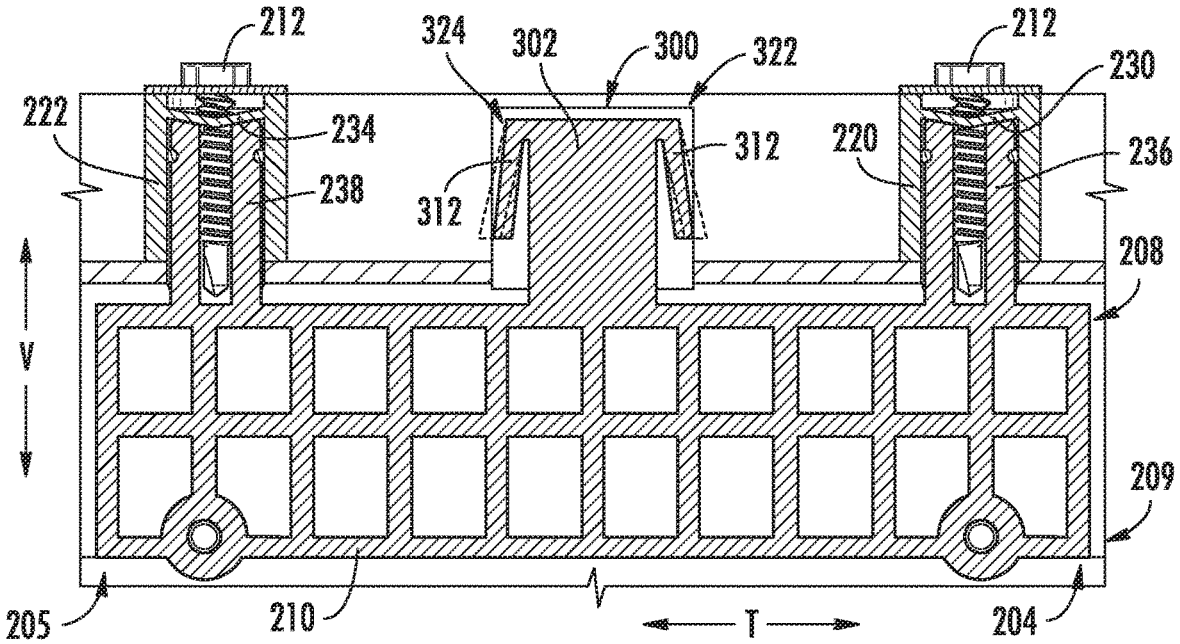
Figure 16:
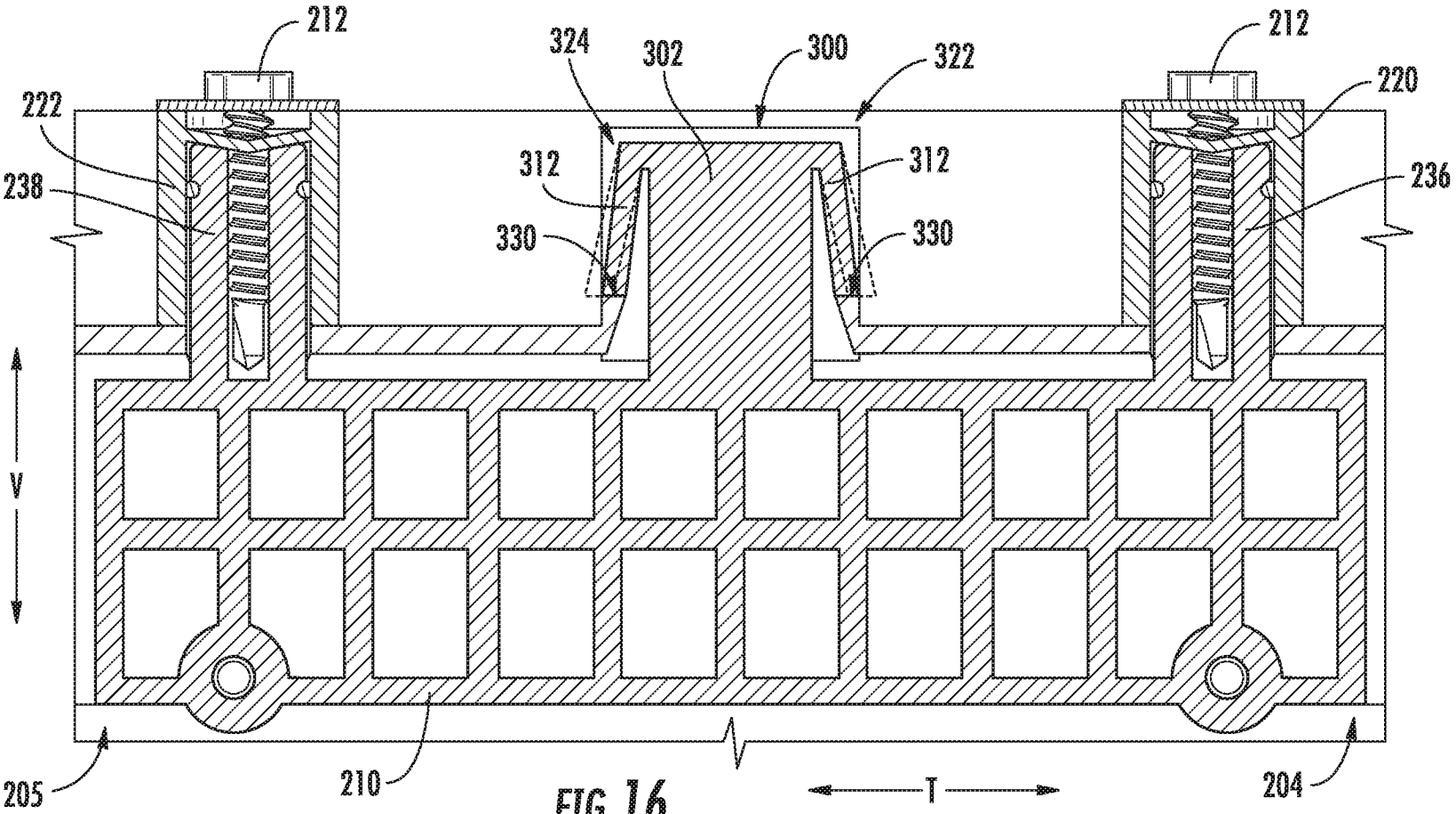

FIGS. 13, 14, 15, and 16 provide various views of features of another exemplary embodiment of rack mounting assembly 200. In particular, FIG. 13 provides a partial exploded view of rack mounting assembly 200 depicting mounting body 210 positioned for mounting to tub 104. FIG. 14 provides a perspective view of mechanical fasteners 212 positioned for being driven into tub 104. FIG. 15 provides a close-up, side cross-sectional view of rack mounting assembly 200. FIG. 16 provides another close-up, side cross-sectional view of rack mounting assembly 200 depicting undercut features of tub 104. The exemplary rack mounting assembly 200 of FIGS. 13, 14, 15, and 16 is configured in a similar manner as the rack mounting assembly of FIGS. 4 through 7, and accordingly, the same or similar numbering refers to the same or similar part.

For this embodiment, tub 104 and mounting body 210 define various additional features for ensuring proper alignment of mounting body 210. For example, tub 104 may define one or more alignment slots 300. In addition, rack assembly 200 may include one or more protruding members 302, which may be, for example, defined by or in mounting body 210. Notably, alignment slots 300 and protruding members 302 are designed such that when protruding members 302 engage alignment slots 300 of tub 104 (or vice/versa), first and second mounting posts 236, 238 are substantially aligned with first hole 224 of first tub boss 220 and second hole 226 of second tub boss 222, respectively. Thus, in this manner, an operator may position mounting body 210 in its proper position in tub 104 prior to driving fasteners 212. This prevents the inadvertent puncturing of tub 104, e.g., by driving screws when mounting body 210 is improperly positioned, thereby reducing the risk of leaks in tub 104 and simplifying assembly.

Notably, as used herein, "alignment slots" may be used generally to refer to any feature or recess defined by tub 104 for use in aligning mounting body 210. For example, alignment slots may be one or more of a recessed slot or cavity, a dimple, a keyed surface feature, or any other suitable feature configured for receiving a "protruding member." Thus, similarly in this regard, "protruding members" may be used generally to refer to any feature defined by, mounted to, or extending from mounting body 210 for engaging, inserting, or otherwise being received within the corresponding "alignment slot." For example, protruding members may be one or more of a protruding part or member, a bump, a keyed surface feature, or any other suitable feature. Although the discussion herein illustrates exemplary alignment slots and protruding members, it should be appreciated that these are only exemplary and are not intended to limit the scope of the present subject matter in any manner.

For this embodiment, alignment slot 300 is an elongated recess defined in tub 104 and protruding member 302 is an elongated tab having a substantially complementary shape to alignment slot 300. For this embodiment, as shown in FIGS. 14 and 15, alignment slot 300 is defined along a connecting rib 304 spanning between first tub boss 220 and second tub boss 222, e.g., along the transverse direction T. An inner opening of alignment slot 300 is defined at inner surface 214 of tub 104 (FIG. 13). As illustrated, protruding member 302 extends from mounting body 210 substantially along the vertical direction V and is configured for receipt in alignment slot 300. Although protruding member 302 is illustrated as a single elongated tab extending in a plane perpendicular to the lateral direction L, it should be appreciated that any suitable number, size, shape, spacing, and orientation of protruding members 302 may be used according to alternative embodiments.

Alignment slots 300 and protruding members 302 may be sized, shaped, and positioned in any suitable manner for achieving the desired interaction between tub 104 and mounting body 210. For example, as best shown in the exemplary embodiment of FIG. 13, protruding member 302 is centered along a transverse length of mounting body 210. However, in alternative embodiments, protruding member 302 is positioned off-center along the length of mounting body 210. Notably, an off-center protruding member 302 will assist in preventing an operator from installing mounting body 210 in the wrong orientation or direction, e.g., such that first side 206 is facing away from upper rack assembly 126 (FIG. 3). Notably, when protruding member 302 is off-center, tub 104 must also define alignment slots 300 asymmetrically between the left and right sides 110 of tub 104. In addition, in some embodiments, alignment slot 300 is defined in radiused corner 202 such that mounting body 210 may be installed in or at radiused corner 202.

Mounting body 210 includes features for retaining mounting body 210 in position after protruding member 302 is inserted into alignment slot 300. These features may facilitate simplified installation of mounting body 210 within tub 104. These features, referred to herein as "retention features" 310, are generally configured to form an interference fit with the surfaces of tub 104 defining alignment slot 300. In this manner, once protruding member 302 is inserted into alignment slot 300, retention features 310 provide resistance to the removal of mounting body 210 from tub 104.

As shown best in FIG. 13, retention feature 310 extends from protruding member 302. More specifically, protruding member 310 is illustrated as a flexible arm 312 having a fixed end 314 and a free end 316. Fixed end 314 is positioned proximate a top 320 of protruding member 302 and free end 316 extends away from protruding member 302 in a cantilevered manner. For this embodiment, free end 316 is positioned below fixed end 314 along the vertical direction V. However, it should be appreciated that flexible arm 312 may extend from any other suitable location on protruding member 302 and in any other suitable direction.

Moreover, mounting body 210 can include any suitable type, number, and configuration of retention features 310. For example, as best shown in FIG. 13, retention feature 310 includes a first flexible arm 312 that extends from a first side 322 of protruding member 302 and a second flexible arm 312 that extends from a second side 324 of protruding member 302. In this manner, flexible arms 312 are separated along the transverse direction T, e.g., with one being closer to front 111 of tub 104 and one being close to rear 112 (FIG. 2). It should be appreciated that flexible arms 312 could instead extend from a front side and/or a backside of protruding member 302 or from any other suitable location in alternative embodiments.

Although the illustrated embodiment shows two flexible arms 312 extending from opposite sides of protruding member 302, alternative embodiments could include a single arm or more than two arms extending in any other suitable directions. In addition, retention features 310 need not be flexible arms at all. For example, retention features 310 could alternatively be bumps, protrusions, or other surface aberrations defined on protruding member 302 which are configured to engage tub 104 within alignment slot 300.

As shown in FIG. 15, once protruding member 302 is inserted into alignment slot 300, retention features 310 provide resistance to the removal of mounting body 210 from tub 104, as noted above. In particular, flexible arm 312 on first side 322 of protruding member 302 moves from its relaxed state (shown in dashed lines) to its compressed state (shown in solid lines). Likewise, flexible arm 312 on second side 324 of protruding member 302 moves from its relaxed state (shown in dashed lines) to its compressed state (shown in solid lines). When flexible arms 312 are in the compressed state, flexible arms 312 engage their respective sidewalls of tub 104 that defines alignment slot 300 and each apply a force on tub 104, and consequently, protruding member 302 retains mounting body 210 in place so that fasteners 212 may further secure mounting body 210 to tub 104.

As shown in FIG. 16, in some embodiments, tub 104 may define additional features to improve the engagement of protruding member 302 within alignment slot 300. For example, tub 104 may define a recessed undercut 330 within alignment slot 300. Recessed undercut 330 may have a shape complementary to retention features 310 (e.g. flexible arms 312) such that retention features 310 engage the recessed undercut 330 when protruding member 302 is fully inserted into alignment slot 300. In this manner, the recessed undercut 330 defined by tub 104 adjacent alignment slot 300 may lock protruding member 302 in place and prevent its removal absent excessive force.

Figure 17:
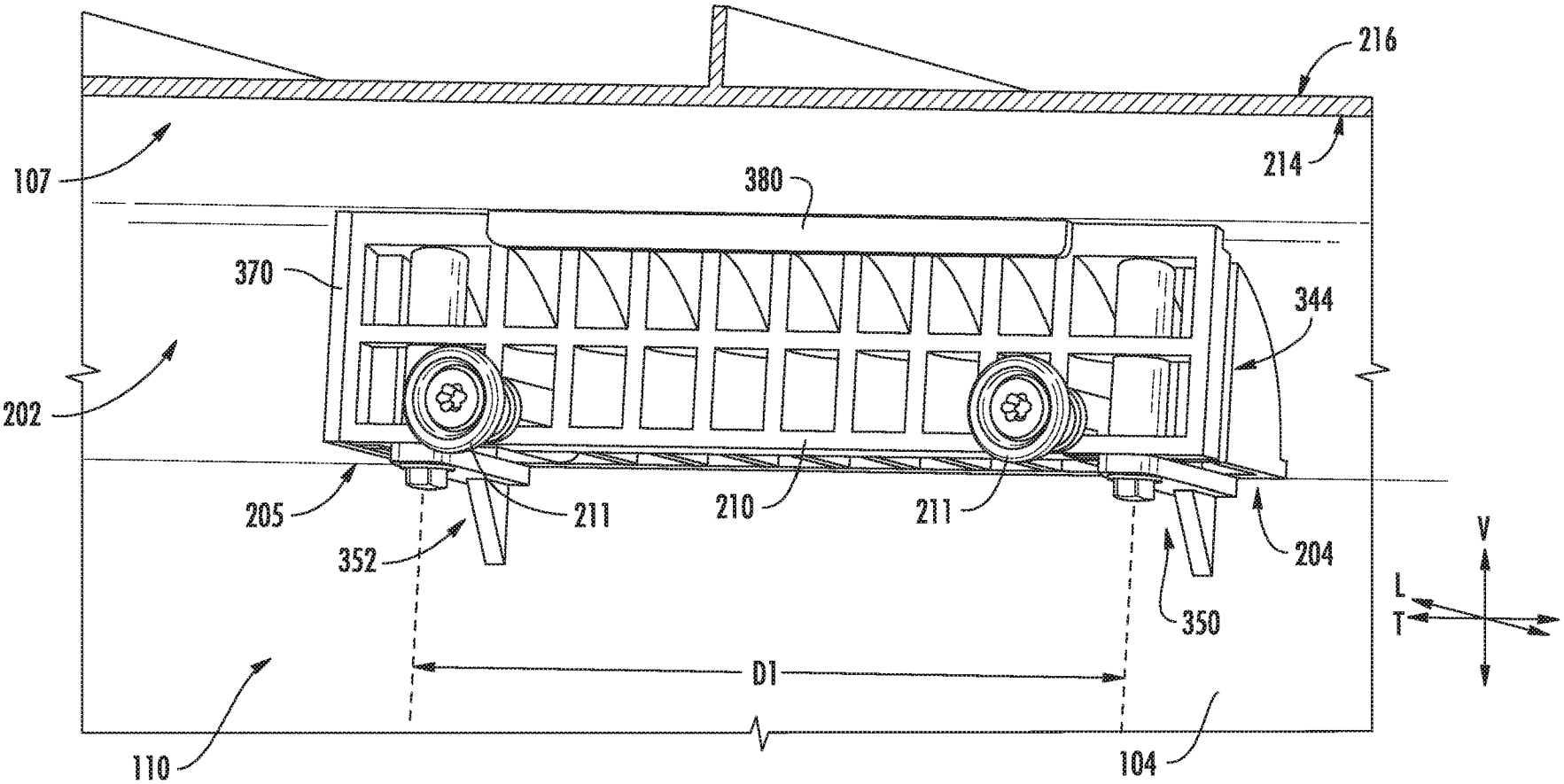
FIGS. 17 through 22 provide various view of another exemplary rack mounting assembly being mounted to a tub of a dishwasher appliance according to an exemplary embodiment of the present subject matter.
Figure 18:
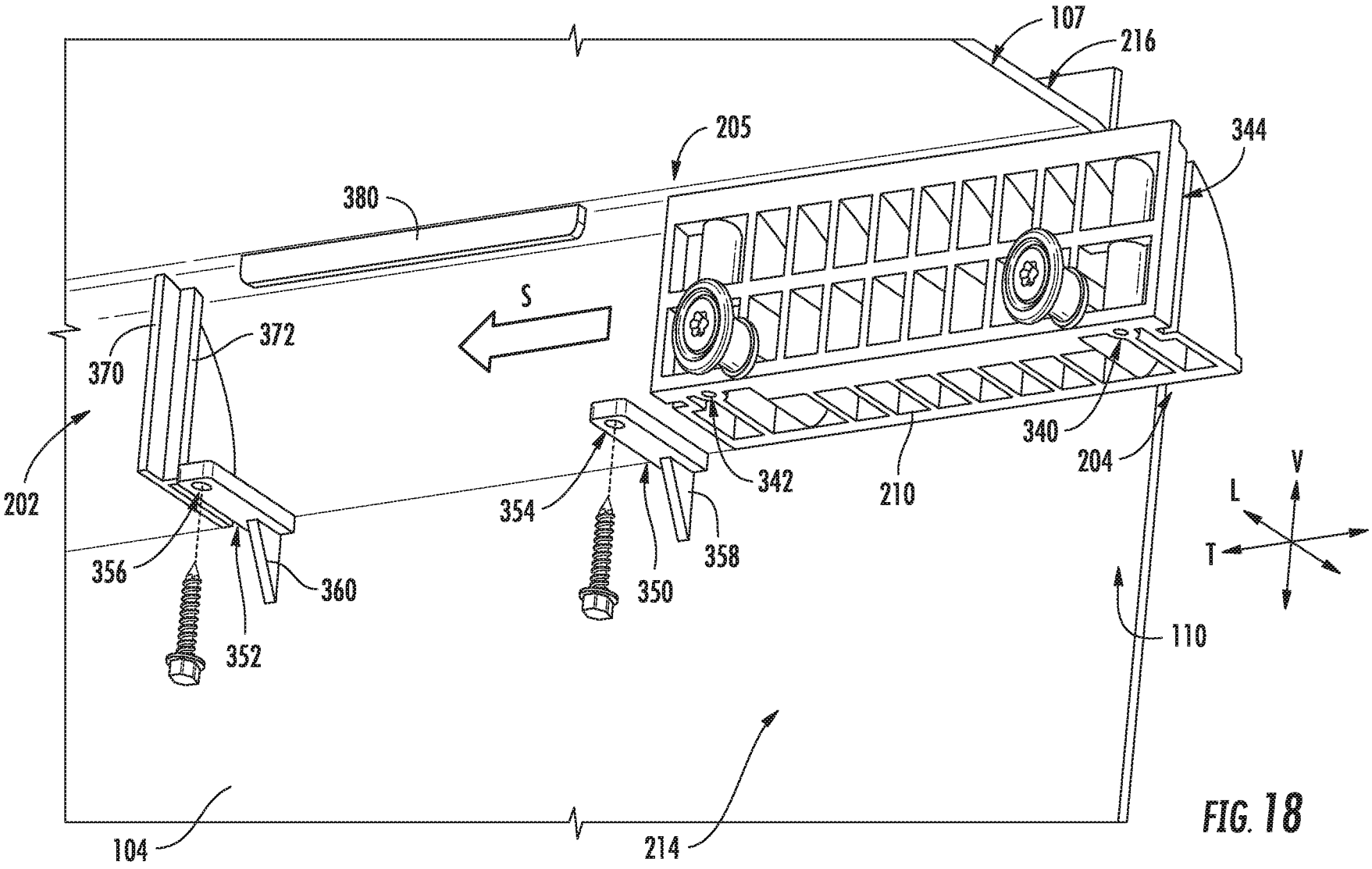
Figure 19:
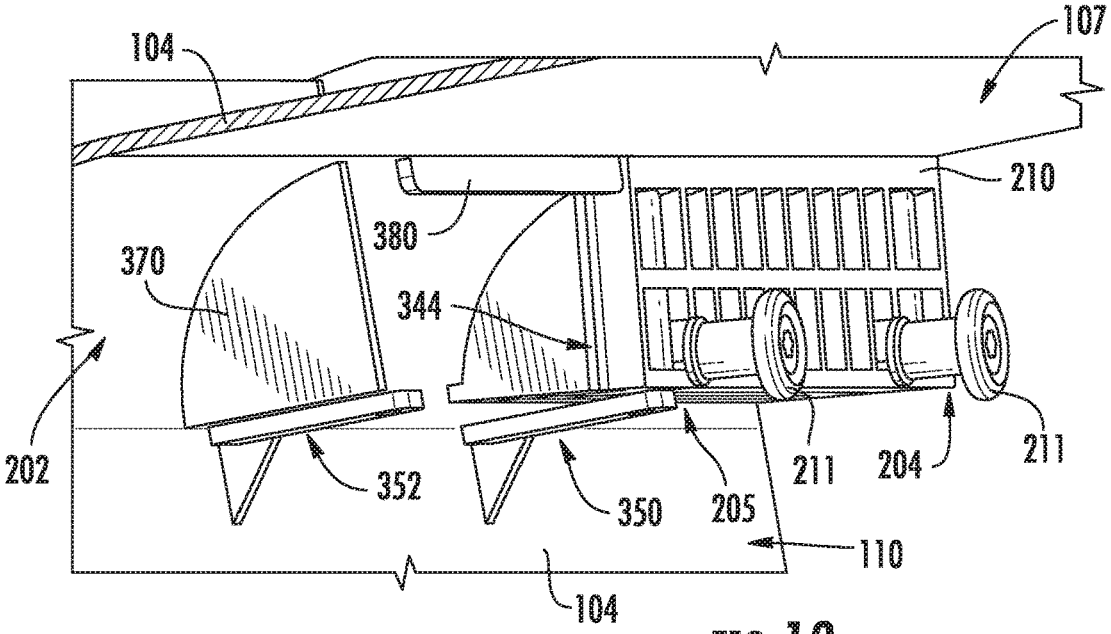
Figure 20:
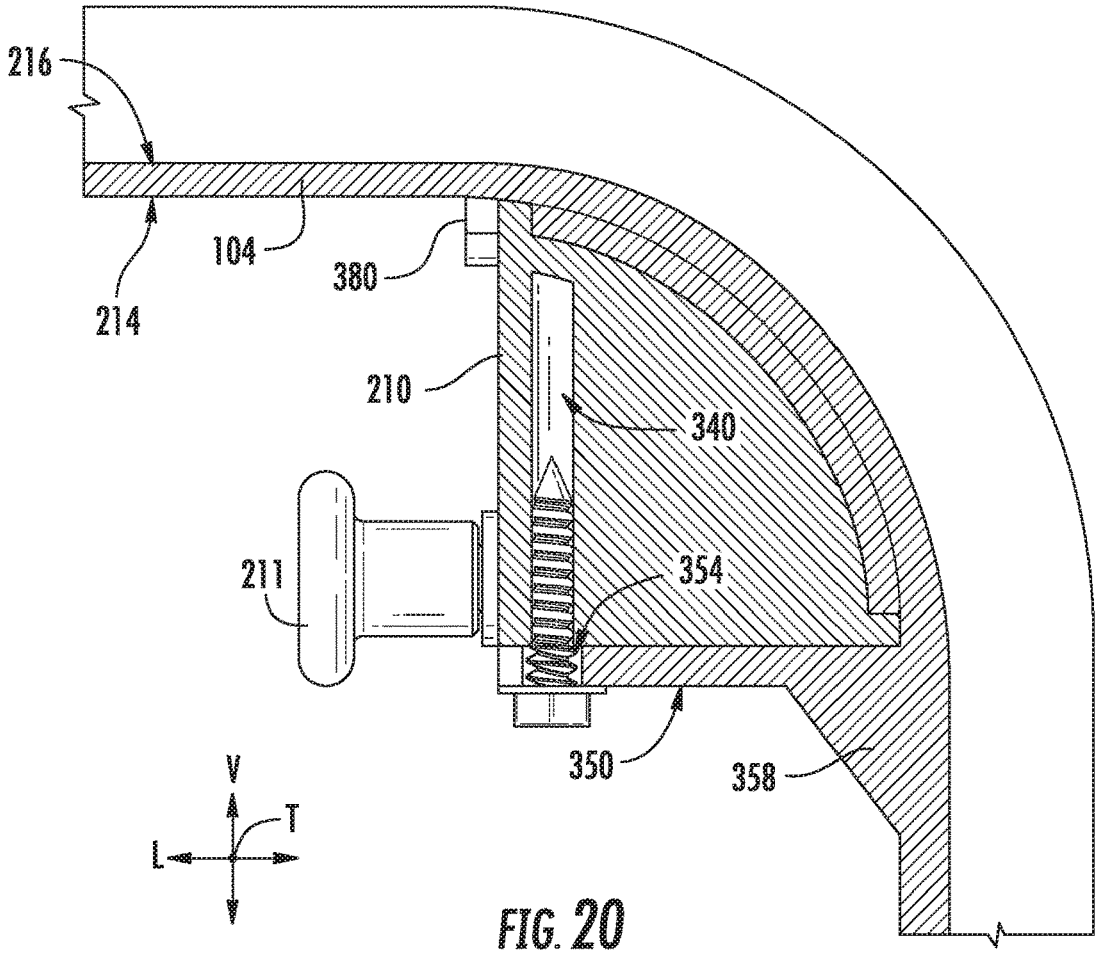
Figure 21:
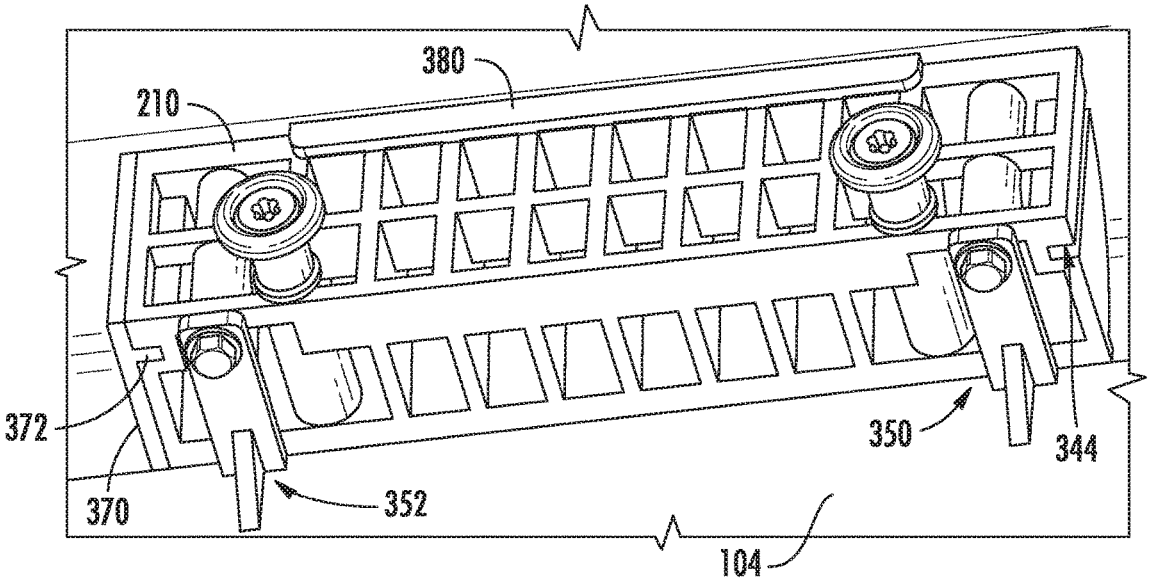
Figure 22:
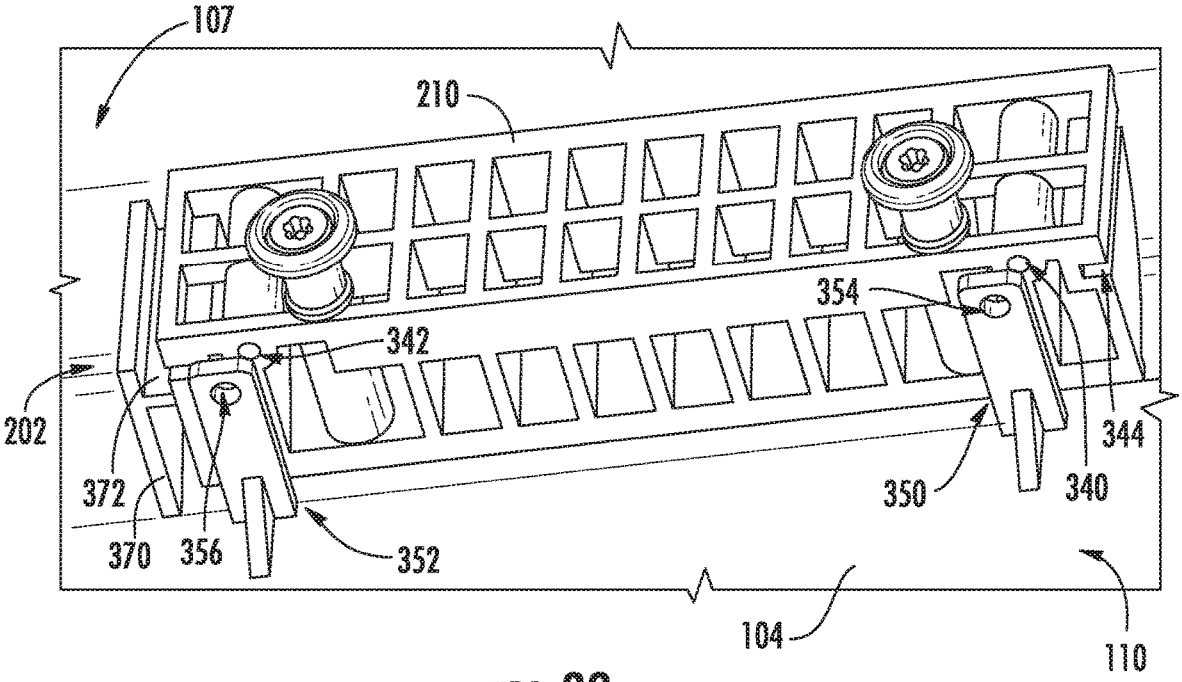

FIGS. 17, 18, 19, 20, 21, and 22 provide various views of features of another exemplary embodiment of rack mounting assembly 200. In particular, FIG. 17 provides a perspective view of rack mounting assembly 200 mounted to tub 104, which is shown partially in cross section. FIG. 18 provides a partial exploded view of rack mounting assembly 200 depicting mounting body 210 positioned for mounting to tub 104. FIG. 19 provides a perspective view of mounting body 210 being mounted to tub 104. FIG. 20 provides a close-up, front cross-sectional view of rack mounting assembly 200. FIG. 21 provides a bottom perspective view of mounting body 210 mounted to tub 104. FIG. 22 provides another bottom perspective view of mounting body 210 being mounted to tub 104. The exemplary rack mounting assembly 200 of FIGS. 17 through 22 has some similar features as the rack mounting assembly of FIGS. 4 through 7, and accordingly, the same or similar numbering refers to the same or similar part.

For this embodiment, mounting body 210 defines a first blind hole 340 and a second blind hole 342 spaced from first blind hole 340, e.g., along the transverse direction T. As shown best in FIG. 20, first blind hole 340 does not extend through mounting body 210 (hence, first blind hole 340 is a blind hole). Second blind hole 342 likewise does not extend through mounting body 210. The openings of first and second blind holes 340, 342 are defined by bottom 209 of mounting body 210 and the first and second blind holes 340, 342 are defined by mounting body 210 generally along the vertical direction V at first side 206 of mounting body 210.

In addition, as shown best in FIG. 19, mounting body 210 defines a vertical groove 344 at back end 205. Vertical groove 344 extends along the vertical direction V. For this embodiment, vertical groove 344 extends along the entire vertical length of mounting body 210. In a similar manner, as best shown in FIG. 18, mounting body 210 defines another vertical groove 344 at front end 204. Vertical groove 344 extends along the vertical direction V, and for this embodiment, vertical groove 344 extends along the entire vertical length of mounting body 210 at front end 204. In some embodiments, mounting body 210 defines a vertical groove at only one of its front end 204 and back end 205. In this embodiment, as noted above, mounting body 210 defines vertical grooves 344 at its back and front ends 205, 204, and thus, mounting body 210 may be assembled proximate right side wall 110 or left side wall 110, e.g., as shown in FIG. 3.

Moreover, for this embodiment, tub 104 includes a first cantilevered support 350 projecting from inner surface 214 and a second cantilevered support 352 projecting from inner surface 214 of tub 104. Particularly, first cantilevered support 350 and second cantilevered support 352 project from inner surface 214 of side wall 110 of tub 104. First cantilevered support 350 and second cantilevered support 352 each project from tub 104 along the lateral direction L. Second cantilevered support 352 is spaced from first cantilevered support 350, e.g., along the transverse direction T. First cantilevered support 350 is positioned forward of second cantilevered support 352. First cantilevered support 350 extends between a proximal end connecting to sidewall 110 of tub 104 and a distal end, e.g., along the lateral direction L. First cantilevered support 350 defines a first throughhole 354 at its distal end. Similarly, second cantilevered support 352 extends between a proximal end connecting to sidewall 110 of tub 104 and a distal end, e.g., along the lateral direction L. Second cantilevered support 352 defines a second throughhole 356 at its distal end. A first brace member 358 supports first cantilevered support 350 at its proximal end and a second brace member 360 supports second cantilevered support 352 at its proximal end.

As shown, tub 104 further includes a stop rib 370 projecting from radiused corner 202 of tub 104 in a cantilevered manner. Stop rib 370 projects from tub 104 in a plane orthogonal to the transverse direction T. Stop rib 370 is spaced rearward of second cantilevered support 352, e.g., along the transverse direction T. Stop rib 370 projects from tub 104 along the lateral direction L a distance that is complementary to the distance that mounting body 210 extends between its first side 206 and second side 207 along the lateral direction L. Stop rib 370 projects from tub 104 along the vertical direction V from the top portion of radiused corner 202 (e.g., where top wall 107 joins with radiused corner 202) to a vertical position proximate where first and second cantilevered supports project from sidewall 110. Moreover, stop rib 370 includes an alignment projection 372 projecting from stop rib 370 in a plane orthogonal to the lateral direction L. Alignment projection 372 projects in a forward direction from stop rib 370 along the transverse direction T. Notably, offset from the middle of stop rib 370 to ensure mounting body 210 is mounted in the proper orientation.

When mounting body 210 is mounted to tub 104, second side 207 of mounting body 210 engages stop rib 370. Advantageously, stop rib 370 provides a stop and alignment feature for mounting body 210 when it is slid into position as shown by a direction arrow S in FIG. 18. Further, alignment projection 372 ensures that mounting body 210 is fully seated against stop rib 370 and also ensures concentric alignment of first blind hole 340 of mounting body 210 with first throughhole 354 of first cantilevered support 350 and concentric alignment of second blind hole 342 of mounting body 210 with second throughhole 356 of second cantilevered support 352. In this way, one fastener 212 may be inserted upward U along the vertical direction V through first throughhole 354 of first cantilevered support 350 and into first blind hole 340 of mounting body 210 to secure mounting body 210 to first cantilevered support 350 and one fastener 212 may be inserted upward U along the vertical direction V through second throughhole 356 of second cantilevered support 352 and into second blind hole 342 of mounting body 210 to secure mounting body 210 to second cantilevered support 352. Accordingly, mounting body 210 is supported by first cantilevered support 350 at or proximate its front end 204 and mounting body 210 is supported by second cantilevered support 352 at or proximate back end 205.

Tub 104 further includes a top rib 380 projecting from inner surface 214 of tub 104. More specifically, top rib 380 projects from tub 104 where top wall 107 joins with radiused corner 202. Top rib 380 projects from inner surface 214 of tub 104 in a plane that is orthogonal to the lateral direction L. Moreover, top rib 380 projects from tub 104 such that top rib 380 and the distal ends of first cantilevered support 350 and second cantilevered support 352 are aligned with top rib 380 along the lateral direction L. As shown particularly in FIG. 20, top rib 380 is positioned slightly laterally inward of the distal ends of first cantilevered support 350 and second cantilevered support 352. Further, as shown in FIG. 17, a distance D1 is defined between first cantilevered support 350 and second cantilevered support 352 along the transverse direction T. For this embodiment, top rib 380 extends along the transverse direction T substantially the distance D1. In preferred embodiments, top rib 380 extends along the transverse direction T at least three quarters (¾) of the length of distance D1. Advantageously, top rib 380 provides an alignment feature for mounting body 210 when it is slid into position as shown by a direction arrow S in FIG. 18. Top rib 380 also retains or secures top 208 of mounting body 210 in place.

An exemplary manner in which mounting body 210 maybe secured to tub 104 will now be provided. Mounting body 210 is first slid into place. For instance, as shown in FIG. 18, mounting body 210 is slid in a direction S along the transverse direction T. As mounting body 210 is slid into position, top rib 380 constrains mounting body 210 in the lateral direction L. First cantilevered support 350, second cantilevered support 352, and radiused corner 202 constrain mounting body 210 in the vertical direction V, e.g., as shown in FIG. 19. When mounting body 210 is fully seated in position, back end 205 of mounting body 210 engages stop rib 370 and alignment projection 372 of stop rib 370 is received within vertical groove 344 of mounting body 210, e.g., as shown in FIG. 21. When mounting body 210 is fully seated in position, first blind hole 340 of mounting body 210 is concentrically aligned with first throughhole 354 of first cantilevered support 350 and second blind hole 342 is concentrically aligned with second throughhole 356 of second cantilevered support 352. If alignment projection 372 of stop rib 370 is not received within vertical groove 344 of mounting body 210, as shown in FIG. 22, then first blind hole 340 of mounting body 210 may not be concentrically aligned with first throughhole 354 of first cantilevered support 350 and second blind hole 342 may not be concentrically aligned with second throughhole 356 of second cantilevered support 352.

Once mounting body 210 has been slid into place and properly seated, one fastener 212 is driven downward U along the vertical direction V through first throughhole 354 of first cantilevered support 350 and into first blind hole 340 of mounting body 210. As fastener 212 is driven upward U along the vertical direction V, fastener 212 self-taps or creates its own thread along the sidewall of mounting body 210 defining first blind hole 340. FIG. 20 depicts fastener 212 driven upward U into first blind hole 340 of mounting body 210. Accordingly, fastener 212 secures mounting body 210 to first cantilevered support 350 of tub 104. In a similar fashion, one fastener 212 is driven downward U along the vertical direction V through second throughhole 356 of second cantilevered support 352 and into second blind hole 342 of mounting body 210. As fastener 212 is driven upward U along the vertical direction V, fastener 212 self-taps or creates its own thread along the sidewall of mounting body 210 defining second blind hole 342. Thus, fastener 212 secures mounting body 210 to second cantilevered support 352 of tub 104. Advantageously, for this embodiment, no sealing elements are needed as there are no holes extending through tub 104. Further, rack mounting assembly 200 may be installed without removing tub 104 from cabinet 102.

The various embodiments of rack mounting assembly 200 described herein provide a simple and effective mechanism for installing upper rack assembly 126 or any other suitable rack assembly within dishwasher appliance 100 in a leak-free and reliable manner. Other configurations and benefits will be apparent to those of skill in the art.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A dishwasher appliance defining a vertical, a lateral, and a transverse direction, the dishwasher appliance comprising:

a tub having an inner surface and an outer surface, the inner surface of the tub defining a wash chamber for receipt of articles for washing, the tub further defining a hole extending between an inner opening defined at the inner surface of the tub and a piercing wall, wherein the tub has a tub boss projecting therefrom, the tub boss extending between a bottom end connected to the tub and a top end, the tub boss defining the hole in which the mounting post is received, and wherein the piercing wall is recessed with respect to the top end of the tub boss;

an upper rack assembly slidably positioned within the wash chamber and configured for movement along the transverse direction; and a rack mounting assembly for supporting the upper rack assembly, the rack mounting assembly comprising:

a mounting body;

a mounting post projecting from the mounting body and received within the hole; and a fastener piercing through the piercing wall and extending into the mounting post to secure the mounting body to the tub.

2. The dishwasher appliance of claim 1, wherein the mounting post defines a pilot hole, and wherein the fastener piercing through the piercing wall and extending into the mounting post is received within the pilot hole of the mounting post.

3. The dishwasher appliance of claim 1, wherein the mounting post is a first mounting post, the pilot hole is a first pilot hole, and the fastener is a first fastener, and wherein the tub further defines a second hole spaced from the first hole, the second hole extending between an inner opening defined at the inner surface of the tub and a second piercing wall, and wherein the rack mounting assembly further comprises:

a second mounting post projecting from the mounting body and spaced from the first mounting post, the second mounting post received within the second hole; and a second fastener piercing through the second piercing wall defining the second hole and into a second pilot hole defined by the second mounting post to secure the mounting body to the tub.

4. The dishwasher appliance of claim 1, wherein the tub comprises a top wall and a side wall joined to the top wall by a radiused corner, and wherein the mounting body is mounted to the tub proximate the radiused corner.

5. The dishwasher appliance of claim 1, wherein the mounting post defines a recess extending circumferentially about the mounting post, and wherein the rack mounting assembly further comprises:

a sealing member received within the recess of the mounting post, wherein when the mounting post is received within the hole, the sealing member is positioned between the inner opening and the piercing wall.

6. The dishwasher appliance of claim 1, wherein the hole is defined by a tub boss projecting from the outer surface of the tub, the tub boss comprising an outer rim, and wherein the fastener comprises a head, and wherein the rack mounting assembly further comprises:

a sealing member, wherein the sealing member is positioned between the head of the fastener and the outer rim of the tub boss.

7. The dishwasher appliance of claim 1, wherein the tub defines a snap mounting boss projecting from the outer surface, the snap mounting boss defining a hole that extends through the tub between an inner opening and an outer opening, the snap mounting boss having an outer rim at the outer opening of the hole, and wherein the rack mounting assembly further comprises:

a snap member projecting from the mounting body and having one or more snaps received within the hole of the tub and engaged with the outer rim of the snap mounting boss to retain the mounting body to the tub; and a sealing gasket disposed about a base of the snap member and in sealing engagement with the mounting body and the inner surface of the tub.

8. The dishwasher appliance of claim 1, wherein the tub further defines an alignment slot, and wherein the rack mounting assembly further comprises:

a protruding member projecting from the mounting body and spaced from the mounting post, the mounting post being substantially aligned with the hole when the protruding member is received within the alignment slot of the tub; and a retention feature extending from the protruding member and configured to engage the alignment slot of the tub.

9. The dishwasher appliance of claim 8, wherein the retention feature is a flexible arm having a fixed end positioned proximate a top of the protruding member and a free end extended away from the protruding member in a cantilevered manner.

10. The dishwasher appliance of claim 9, wherein the free end is positioned below the fixed end along the vertical direction.

11. The dishwasher appliance of claim 8, wherein the retention feature comprises a first flexible arm extending from a first side of the mounting body and a second flexible arm extending from an opposing second side of the mounting body.

12. The dishwasher appliance of claim 8, wherein the tub defines a recessed undercut within the alignment slot, the recessed undercut having a shape complementary to the retention feature such that the retention feature engages the recessed undercut when the protruding member is inserted into the alignment slot.

13. The dishwasher appliance of claim 1, wherein the tub and the mounting body are injection-molded using a plastic material.

14. The dishwasher appliance of claim 1, wherein the tub boss has a vertical length extending along the vertical direction, and wherein the piercing wall extends in a plane orthogonal to the vertical length of the tub boss.

15. The dishwasher appliance of claim 1, wherein the mounting post is received within the hole such that the mounting post engages the piercing wall.

16. A dishwasher appliance, comprising:

a tub having an inner surface and an outer surface, the inner surface of the tub defining a wash chamber for receipt of articles for washing, the tub having a tub boss projecting from the outer surface, the tub boss extending between a bottom end connected to the outer surface and a top end, the tub boss defining a hole extending between an inner opening defined at the inner surface of the tub and a piercing wall, the piercing wall being recessed with respect to the top end of the tub boss;

an upper rack assembly slidably positioned within the wash chamber and configured for movement along the transverse direction; and a rack mounting assembly for supporting the upper rack assembly, the rack mounting assembly comprising:

a mounting body;

a mounting post projecting from the mounting body and received within the hole; and a fastener piercing through the piercing wall and extending into the mounting post to secure the mounting body to the tub.

17. The dishwasher appliance of claim 16, wherein the tub boss has a vertical length extending along the vertical direction, and wherein the piercing wall extends in a plane orthogonal to the vertical length of the tub boss.

18. The dishwasher appliance of claim 16, wherein the mounting post is received within the hole such that the mounting post engages the piercing wall.

19. A dishwasher appliance, comprising:

a tub having an inner surface and an outer surface, the inner surface of the tub defining a wash chamber for receipt of articles for washing, the tub having a tub boss projecting from the outer surface, the tub boss extending between a bottom end connected to the outer surface and a top end, the tub boss defining a hole extending between an inner opening defined at the inner surface of the tub and a piercing wall, the piercing wall being recessed with respect to the top end of the tub boss, the tub boss having a vertical length extending along a vertical direction defined by the dishwasher appliance, and wherein the piercing wall extends in a plane orthogonal to the vertical length of the tub boss;

an upper rack assembly slidably positioned within the wash chamber and configured for movement along the transverse direction; and a rack mounting assembly for supporting the upper rack assembly, the rack mounting assembly comprising:

a mounting body;

a mounting post projecting from the mounting body and received within the hole such that the mounting post engages the piercing wall; and a fastener piercing through the piercing wall and extending into the mounting post to secure the mounting body to the tub.

* * * * *